US007566099B2

(12) United States Patent
Catanzarite et al.

(10) Patent No.: US 7,566,099 B2
(45) Date of Patent: Jul. 28, 2009

(54) FURNITURE SEATBACK TILT RECLINE ANGLE LIMITER AND METHOD

(75) Inventors: David Catanzarite, Edinboro, PA (US); Keith Ptak, Erie, PA (US); Jim Maciak, Erie, PA (US)

(73) Assignee: Lord Corporation, Cary, NC (US)

( * ) Notice: Subject to any disclaimer, the term of this patent is extended or adjusted under 35 U.S.C. 154(b) by 612 days.

(21) Appl. No.: 10/691,073

(22) Filed: Oct. 22, 2003

(65) Prior Publication Data

US 2005/0179295 A1 Aug. 18, 2005

(51) Int. Cl.
*B60N 2/02* (2006.01)

(52) U.S. Cl. ..... 297/361.1; 297/362; 297/365; 297/374

(58) Field of Classification Search ..... 297/361.1, 297/363, 364, 365, 374, 354.13, 362
See application file for complete search history.

(56) References Cited

U.S. PATENT DOCUMENTS 3,855,560 A 12/1974 Ward
3,934,216 A 1/1976 Ward
3,976,326 A 8/1976 Grumblatt
4,008,920 A * 2/1977 Arndt ..... 297/364
4,009,856 A 3/1977 Wolters et al.
4,012,158 A 3/1977 Harper
4,013,258 A 3/1977 Doerner
4,067,610 A 1/1978 Doerr et al.
4,219,233 A 8/1980 Rodgers
4,614,454 A * 9/1986 Kassai ..... 297/363
4,647,889 A 3/1987 Addis
4,652,050 A 3/1987 Stevens
4,682,814 A 7/1987 Hansen
4,743,065 A 5/1988 Meiller et al.
4,752,101 A 6/1988 Yurchenco et al.
4,786,108 A 11/1988 Dauphin
4,818,020 A 4/1989 Meiller et al.
5,299,818 A * 4/1994 Newbold ..... 297/363

(Continued)

FOREIGN PATENT DOCUMENTS

DE 3431362 A1 3/1986

(Continued)

OTHER PUBLICATIONS

Derwent World Patents Index, Dialog File No. 351, Accession No. 3630708, English-language Abstract of DE3431362, Mar. 6, 1986, "Movement Damper in Front of Stop- Has Sliding Magnet Moved with Controlled Part and Magnetic Force Control w.r.t. Friction."

*Primary Examiner*—Anthony D Barfield
(74) *Attorney, Agent, or Firm*—Edward F. Murphy, III

(57) ABSTRACT

The invention provides a furniture chair seatback tilt limiter system for adjustably limiting the seatback recline of a chair. The seatback tilt limiter system includes a first gear toothed rotator with a full forward seatback upright endstop and a full recline seatback endstop. The seatback tilt limiter system includes a second gear toothed rotator having an adjustment endstop. The first rotator is free to rotate between the full forward seatback upright endstop and the full recline seatback endstop when the rotator gear teeth are disengaged and the second rotator adjustment endstop limits the rotation of the first rotator to an adjustable reclined seatback tilt limit when the gear teeth are engaged.

23 Claims, 28 Drawing Sheets

U.S. PATENT DOCUMENTS

| | | | | |
|---|---|---|---|---|
| 5,382,079 | A | 1/1995 | Wilson et al. | |
| 5,447,357 | A | 9/1995 | Dauphin | |
| 5,464,274 | A | 11/1995 | Golynsky et al. | |
| 5,683,139 | A | 11/1997 | Golynsky et al. | |
| 6,000,756 | A | 12/1999 | Hybarger et al. | |
| 6,139,104 | A | 10/2000 | Brewer | |
| 6,174,031 | B1 | 1/2001 | Lindgren et al. | |
| D444,638 | S | 7/2001 | Magnusson et al. | |
| 6,371,558 | B1 | 4/2002 | Couasnon | |
| 6,386,528 | B1 | 5/2002 | Thorn et al. | |
| 6,424,245 | B1 | 7/2002 | Rector et al. | |
| D471,024 | S | 3/2003 | Chadwick et al. | |
| 6,565,156 | B1 * | 5/2003 | Yamashita et al. | 297/364 X |
| 2004/0056523 | A1 | 3/2004 | Grable et al. | |

FOREIGN PATENT DOCUMENTS

| | | | |
|---|---|---|---|
| EP | 0592008 | A1 | 4/1994 |
| EP | 0698358 | A2 | 2/1996 |
| EP | 1197167 | A2 | 4/2002 |

* cited by examiner

FURNITURE SEATBACK TILT RECLINE ANGLE LIMITER AND METHOD

FIELD OF THE INVENTION

The present invention relates to a furniture seatback tilt recline angle limiter system and a method for adjustably limiting a seatback tilt recline angle. The invention includes a method of making a furniture seatback tilt recline angle limiter. More particularly the invention relates to a method and mechanical system for providing an adjustable seatback tilt angle limit, and particularly to a robust cost efficient tilt angle limiter with a control switch.

BACKGROUND OF THE INVENTION

Furniture, particularly office chairs, normally have a movable seatback to provide for comfort of the person sitting in the seat, with the seatback having flexible motion between a forward upright position and a backward leaning reclined position. There is a need for a robust furniture seatback tilt recline angle limiter mechanism that is economically manufacturable and provides for an adjustment of the recline angle of the seatback by the person using the seat so that the seat user can adjust how far back the seatback can recline before further backward motion is inhibited.

SUMMARY OF THE INVENTION

The invention includes a seatback tilt limiter for adjustably limiting the flexible recline of a seatback. The seatback tilt limiter is comprised of a first rotator with repeating periodic protrusions and a second rotator with repeating periodic receivers for receiving the protrusions. The first rotator has a full forward seatback upright endstop and a full recline seatback endstop. The second rotator has an adjustment endstop with the first rotator periodic protrusions disengagably received by the second rotator receivers wherein the first rotator is free to rotate between the full forward seatback upright endstop and the full recline seatback endstop when the protrusions are disengaged and not received in the second rotator receivers and the second rotator adjustment endstop limits the rotation of the first rotator and the seatback tilt to an adjustable reclined seatback tilt limit when the protrusions are received is the second rotator receivers.

The invention includes a method of adjusting a tilt limit of a movable seatback. The method includes providing a first toothed rotator with repeating periodic protrusions/receivers, the first toothed rotator having a full forward seatback upright endstop and a full recline seatback endstop. The method includes providing a second toothed rotator meshed to the first toothed rotator with repeating periodic protrusions/receivers with the second toothed rotator having an adjustment endstop. The method includes disengaging the first toothed rotator from the second toothed rotator and positioning the seatback to an adjustable reclined seatback tilt limit between the full forward seatback upright endstop and the full recline seatback endstop with the first toothed rotator rotated relative to the second toothed rotator and engaging the first toothed rotator with the second toothed rotator wherein the seatback is limited to tilting between the forward seatback upright endstop and the adjustable reclined seatback tilt limit.

The invention includes a method of making a seatback tilt limiter for adjustably limiting the flexible recline of a seatback. The method includes providing a first toothed rotator with repeating periodic protrusions/receivers having a full forward seatback upright endstop and a full recline seatback endstop. The method includes providing a second toothed rotator having an adjustment endstop. The method includes providing a resilient member for biasing an engagement of the first toothed rotator with the second toothed rotator and disengagably coupling the first toothed rotator and the second toothed rotator with the resilient member wherein a compression of the resilient member permits the first toothed rotator and the second toothed rotator to disengage to provide for relative rotation between the first toothed rotator and the second toothed rotator to establish an adjusted seatback tilt limit between the full forward seatback upright endstop and the full recline seatback endstop.

The invention includes a seatback tilt limiter magnetic control switch. The magnetic control switch includes a magnetic anchor and a first magnetic target and a second magnetic target. The magnetic anchor has a seatback tilt adjustment position adjacent to the first magnetic target and a seatback limited tilt position adjacent to the second magnetic target wherein a first magnetic attraction between the magnetic anchor and the first target and a second magnetic attraction between the magnetic anchor and the second target inhibit positioning the magnetic control switch in a neutral position between the seatback tilt adjustment position and the seatback limited tilt position.

The invention includes a magnetic control switch. The magnetic control switch includes a magnetic anchor and a first magnetic target and a second magnetic target. The magnetic anchor has a first position adjacent to the first magnetic target and a second position adjacent to the second magnetic target wherein a first magnetic attraction between the magnetic anchor and the first target and a second magnetic attraction between the magnetic anchor and the second target inhibit positioning the magnetic control switch in a neutral position between the first position and the second position.

The invention includes a magnetic control switch. The magnetic control switch includes a control arm having an engaged position and a disengaged position, with the control arm slidably fixed to a frame mount. The switch includes a magnetic anchor magnet, a first magnetic target and a second magnetic target wherein a first magnetic attraction between the magnetic anchor and the first target and a second magnetic attraction between the magnetic anchor and the second target inhibit positioning the control arm in a neutral position between the engaged position and the disengaged position.

The invention includes a magnetic control switch. The magnetic control switch includes a control arm having an engaged position and a disengaged position, a magnetic anchor, a first magnetic target and a second magnetic target wherein a first magnetic repulsion between the magnetic anchor and the first target and a second magnetic repulsion between the magnetic anchor and the second target bias positioning the control arm in a control position between the first magnetic target and the second magnetic target.

The invention includes a magnetic control switch. The magnetic control switch includes a magnetic anchor and a first magnetic target and a second magnetic target. The magnetic anchor has a first position adjacent to the first magnetic target and a second position adjacent to the second magnetic target wherein a first magnetic field between the magnetic anchor and the first target and a second magnetic field between the magnetic anchor and the second target bias positioning the magnetic control switch in a home position.

The invention includes a seatback tilt angle limiter for limiting the recline angle of a seatback. The seatback tilt angle limiter includes a housing endstop contact abutment surface and a rotator having a seatback endstop. The rotator has a center axis of rotation about a shaft and the rotator seatback endstop has an offcenter nonradial endstop contact surface for endstop contact with the housing endstop contact abutment surface with the housing endstop contact abutment surface having a nonradial extension wherein an extension of the housing endstop contact abutment surface does not intersect the shaft. The housing endstop contact abutment surface and the offcenter nonradial endstop contact surface have an offcenter orientation relative to the shaft and the center of rotation.

The invention includes a method of making a furniture seatback tilt angle limiter. The method includes providing a housing endstop contact abutment surface and providing a rotator having a seatback endstop and a center axis of rotation about a shaft. The rotator seatback endstop has an offcenter nonradial endstop contact surface for endstop contact with the housing endstop contact abutment surface. The method includes positioning the rotator proximate the housing endstop contact abutment surface wherein the housing endstop contact abutment surface has an offcenter orientation with the rotator center of rotation, such that an extension of the housing endstop contact abutment surface would not intersect the shaft in that the surface is nonradial.

The invention includes a method of making a seatback tilt limiter for adjustably limiting the recline of a seatback between a seatback forward upright endstop and a seatback full recline endstop. The method includes providing a first toothed rotator gear member with a plurality of repeating periodic gear teeth. The method includes providing a second toothed gear member with a plurality of repeating periodic gear teeth and having an adjustment endstop and disengagably coupling the first toothed rotator gear member repeating periodic gear teeth with the second toothed gear member repeating periodic gear teeth wherein the second toothed gear member adjustment endstop provides an adjustable recline angle seatback endstop between the seatback forward upright endstop and said seatback full recline endstop.

It is to be understood that both the foregoing general description and the following detailed description are exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principals and operation of the invention.

DETAILED DESCRIPTION OF THE INVENTION

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

Figure 1B:
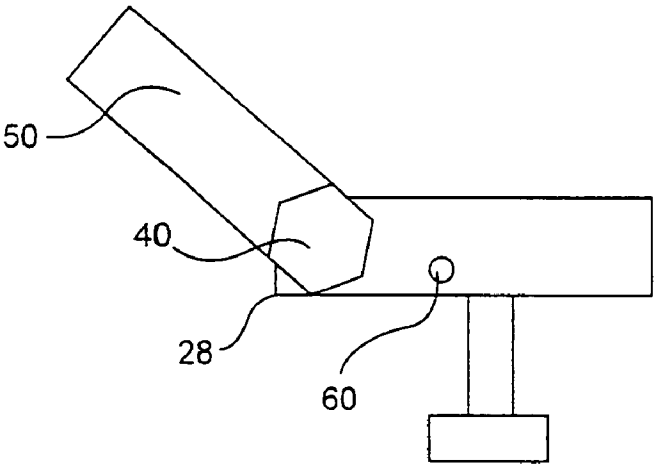
FIG. 1*a-d* shows embodiments of the invention.
Figure 1C:
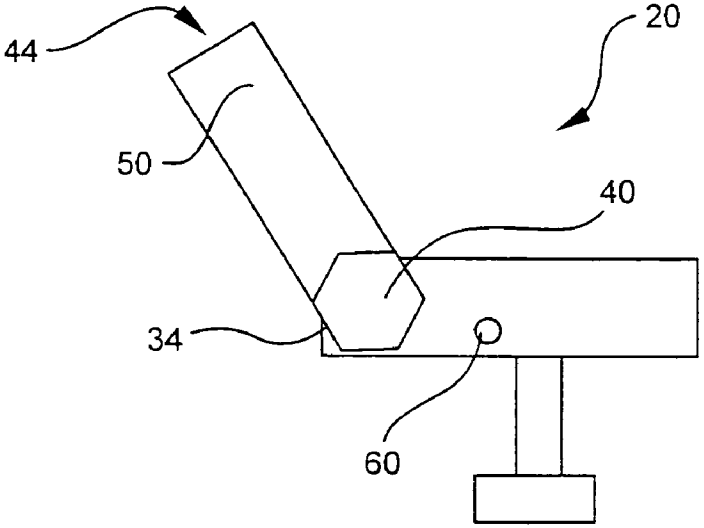
Figure 1A:
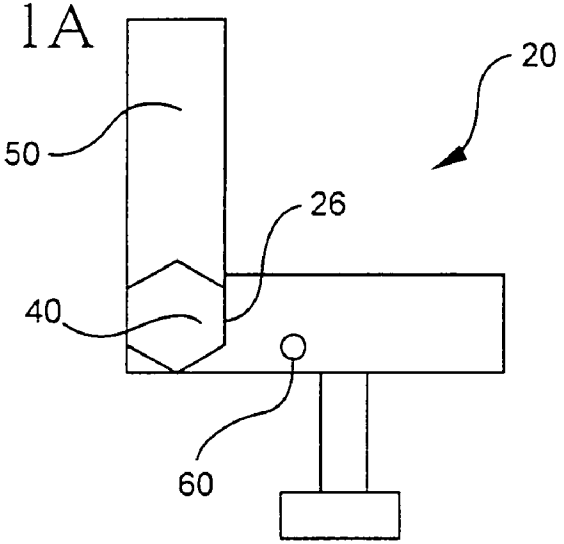
Figure 1D:
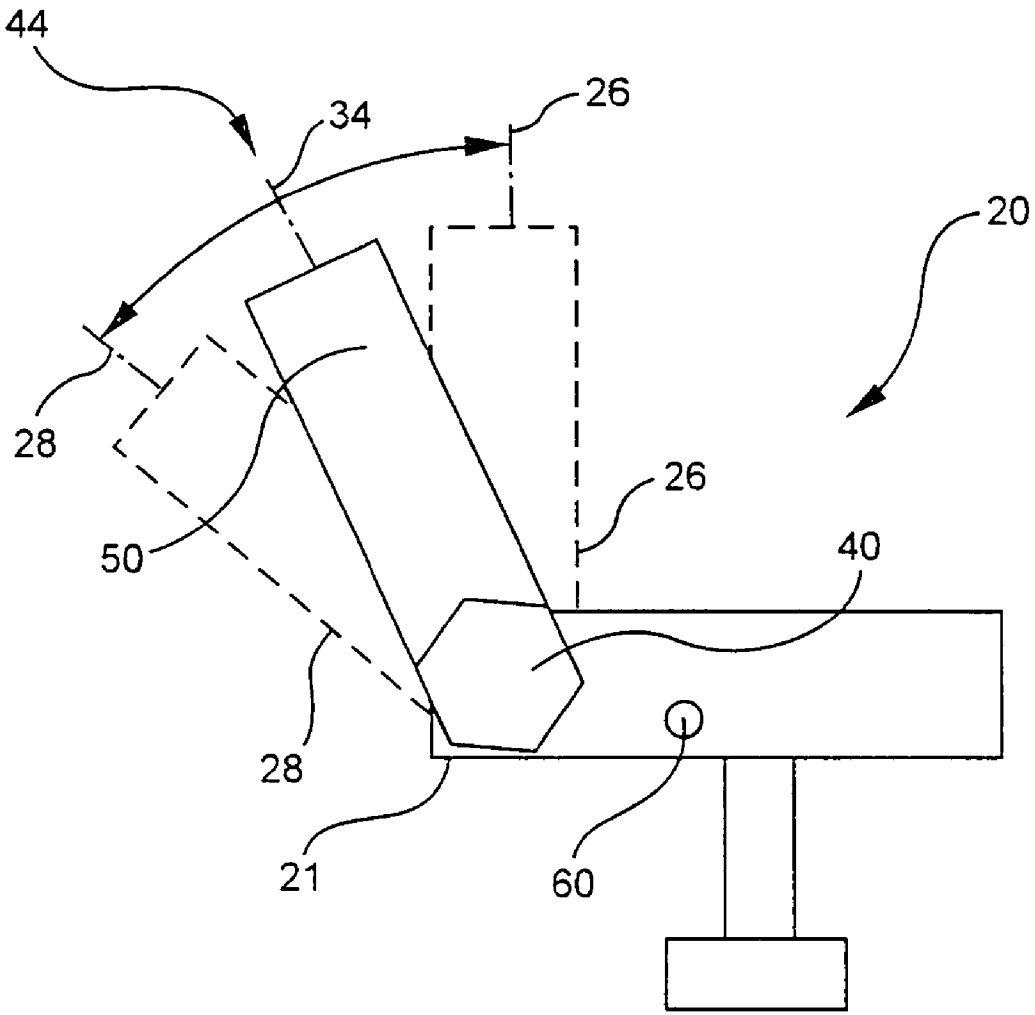
Figure 2A:
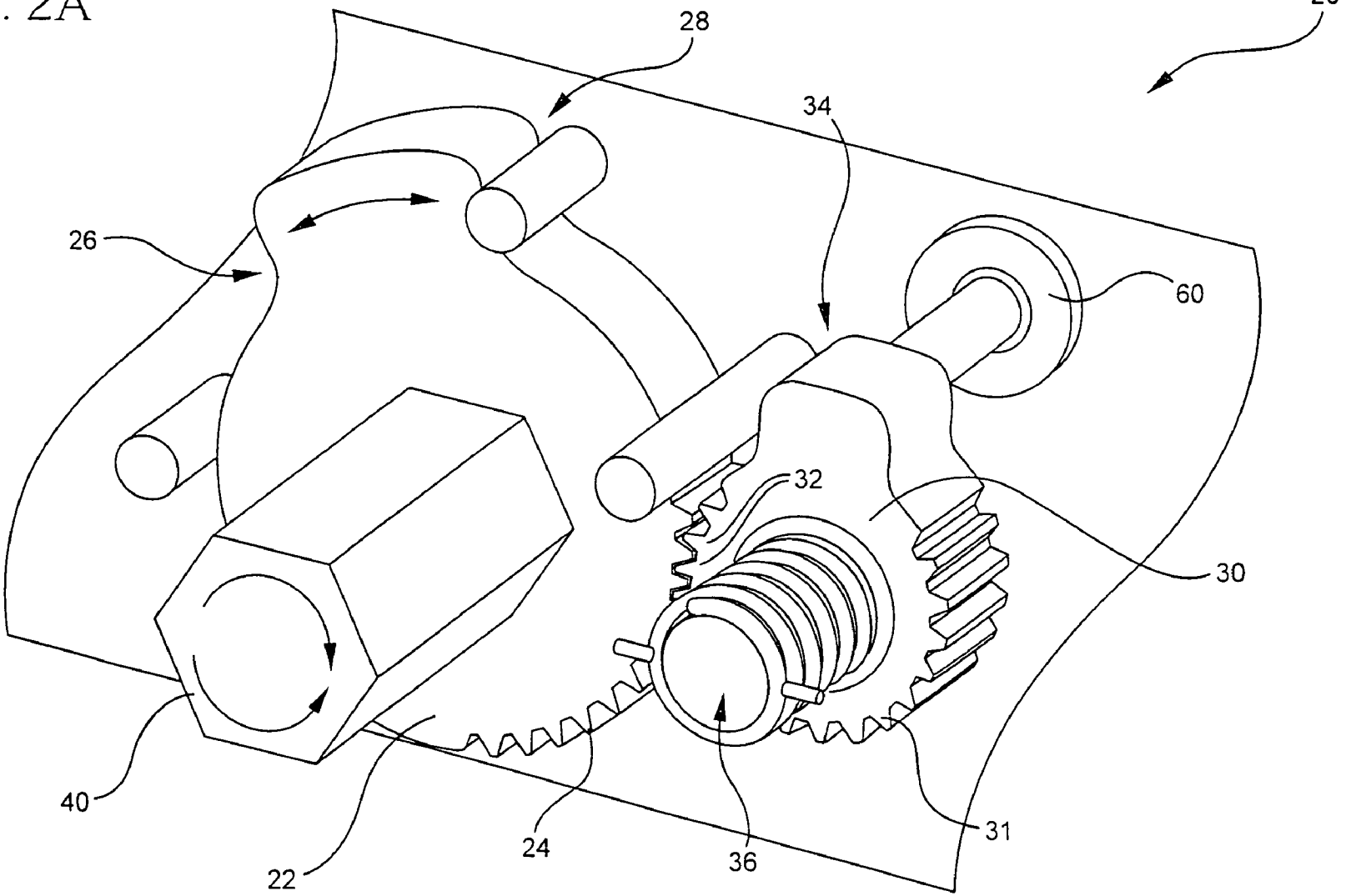
FIG. 2*a-b* show an embodiment of the invention.
Figure 2B:
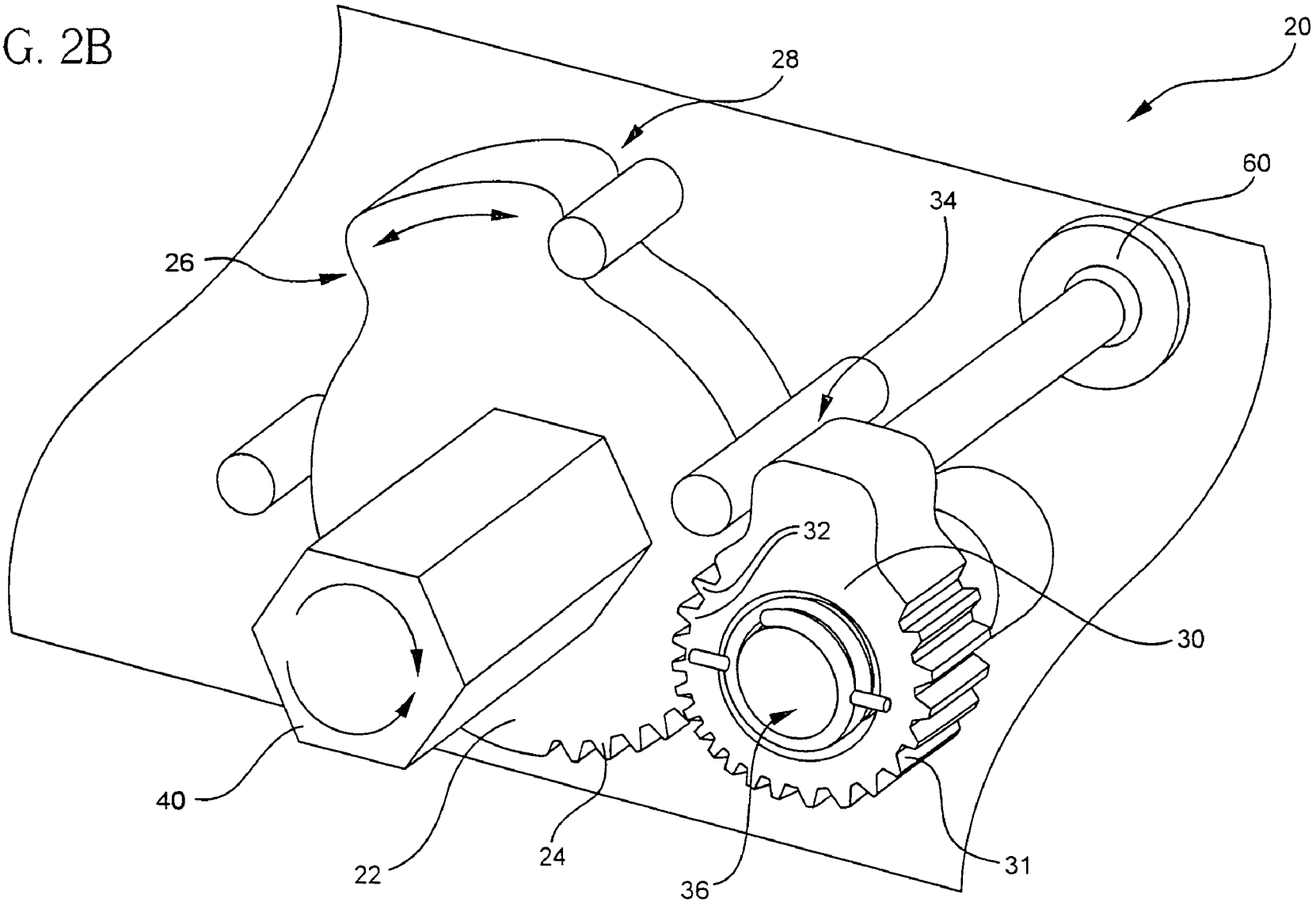
Figure 3A:
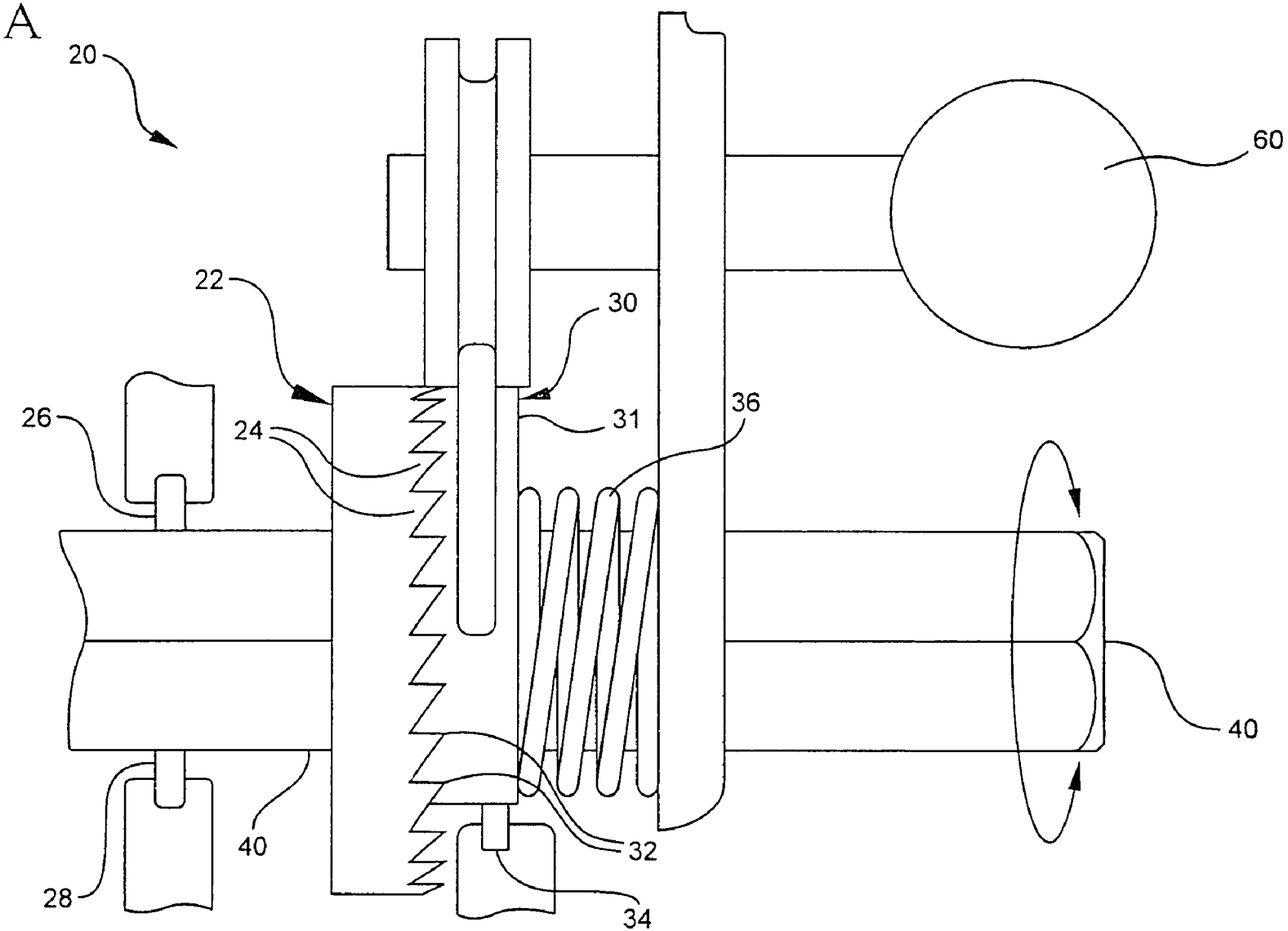
FIG. 3*a-b* show an embodiment of the invention.
Figure 3B:
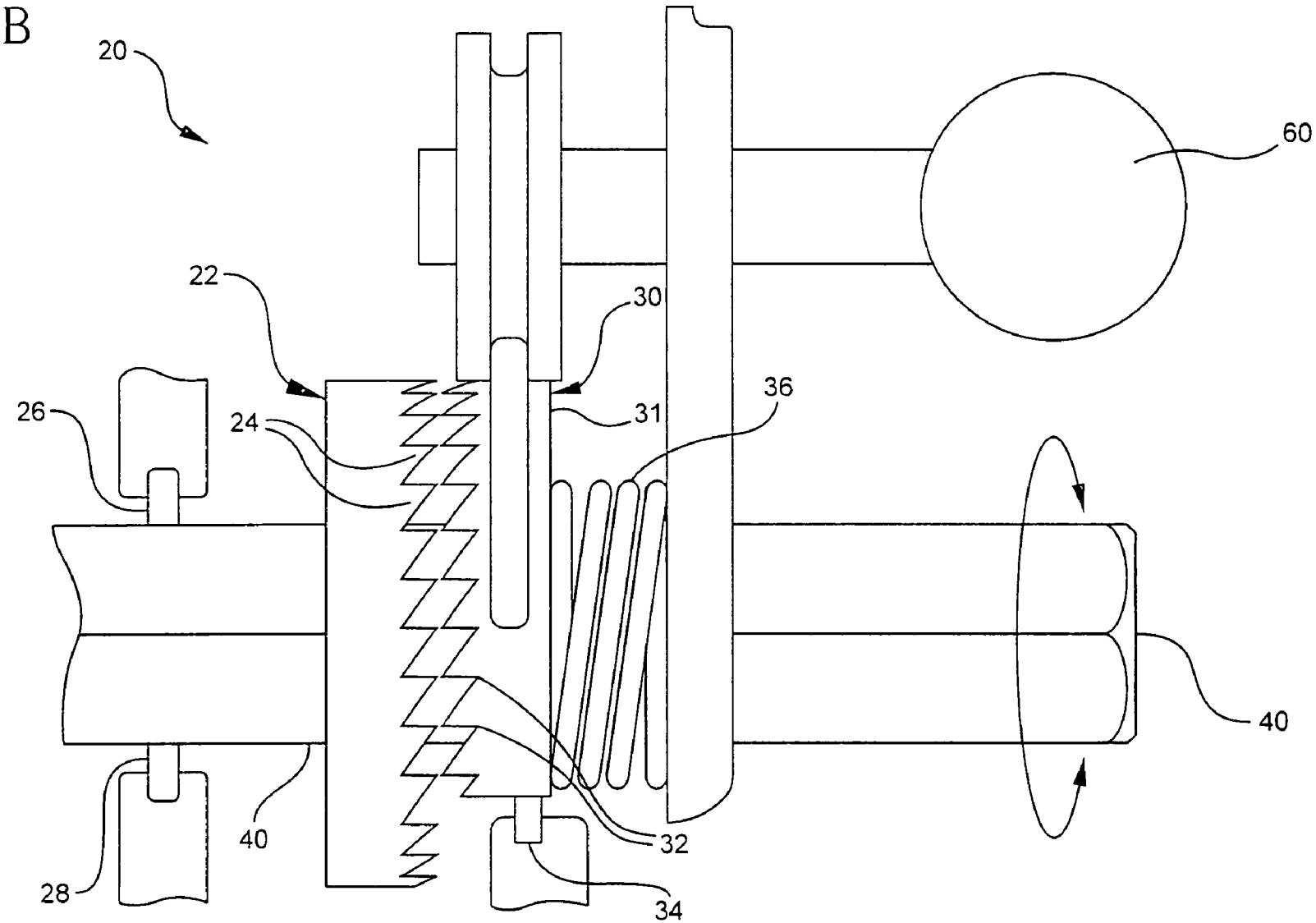
Figure 4A:
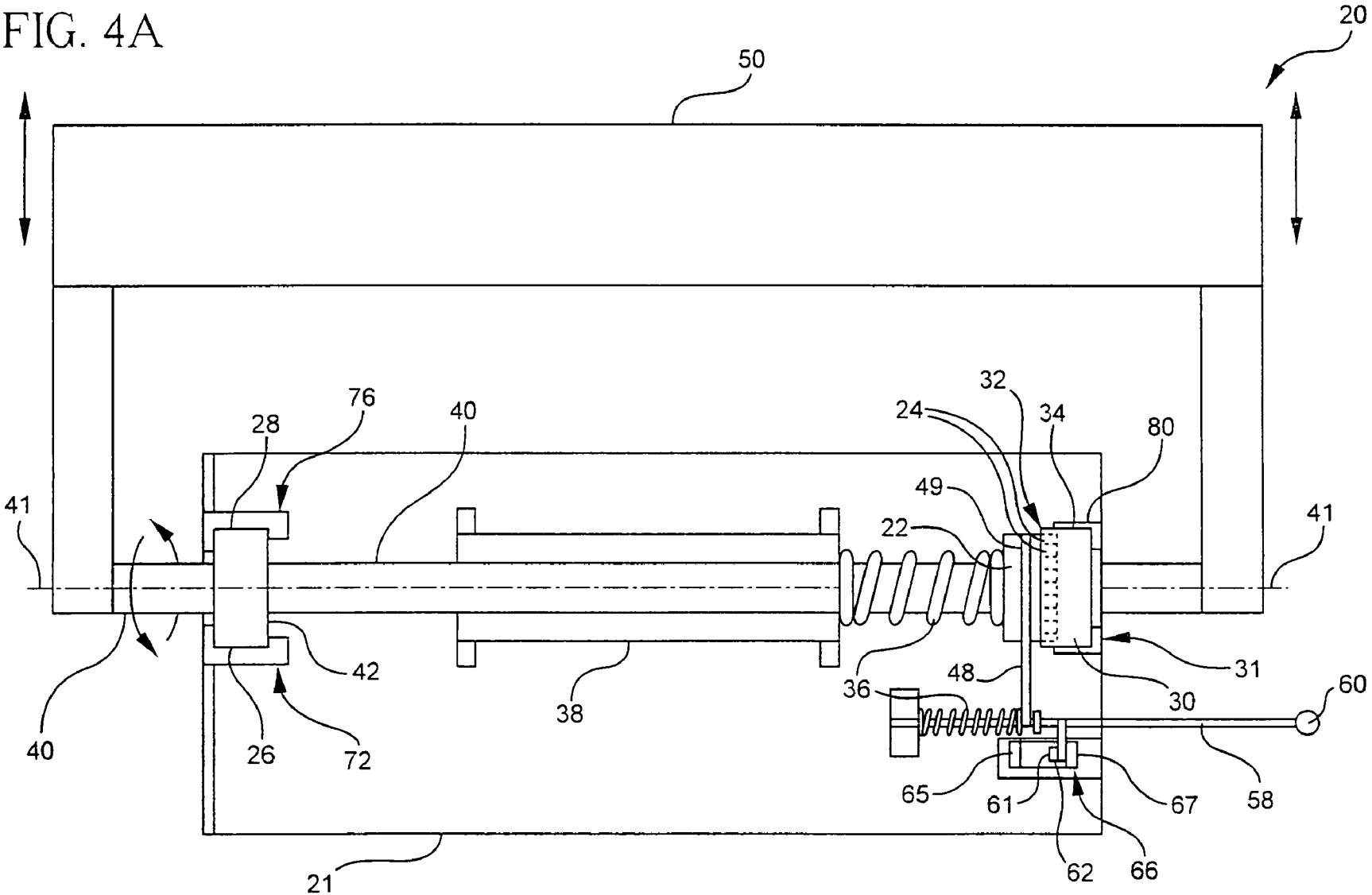
FIG. 4*a-p* shows embodiments of the invention.
Figure 4B:
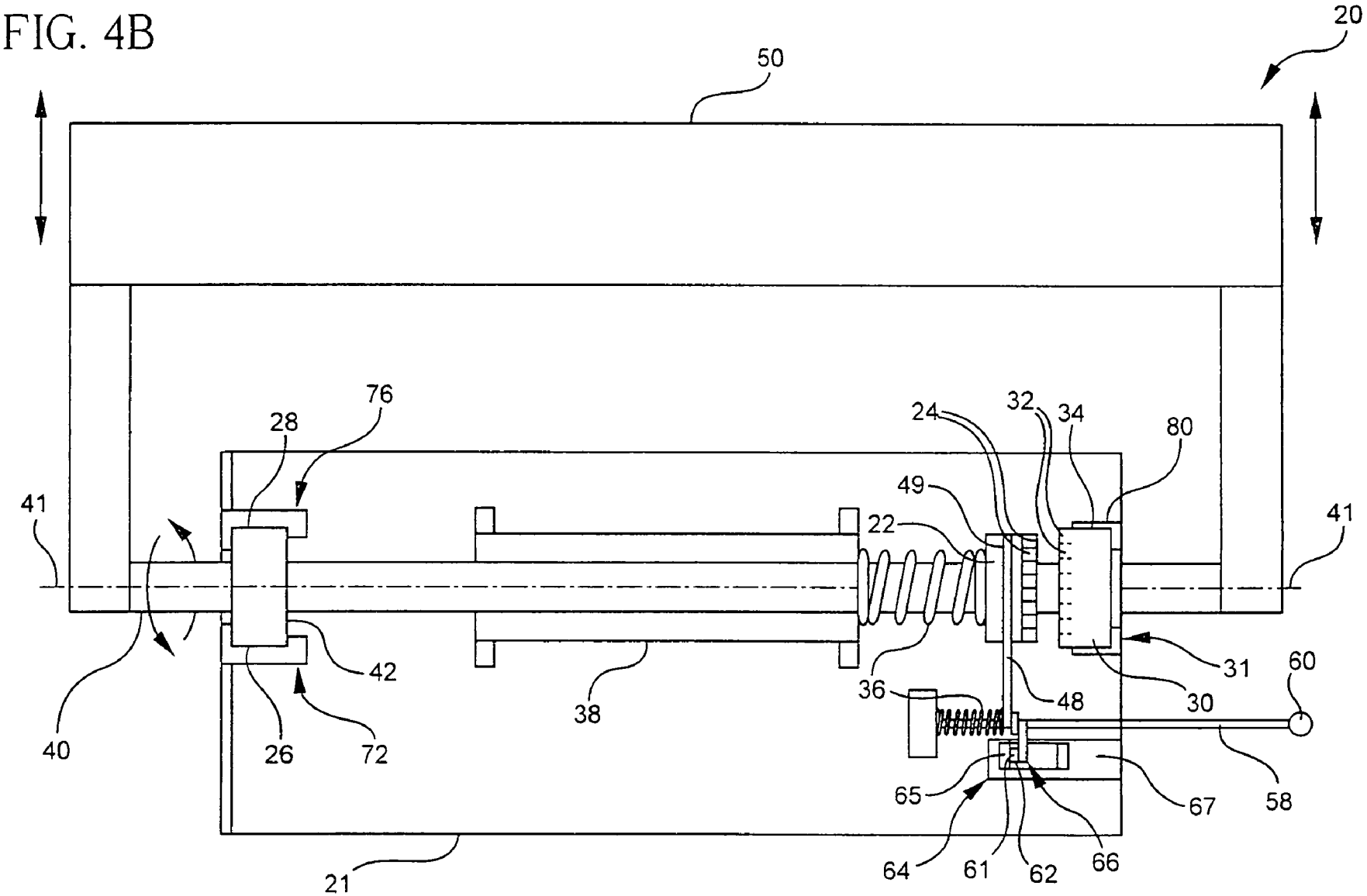
Figure 4C:
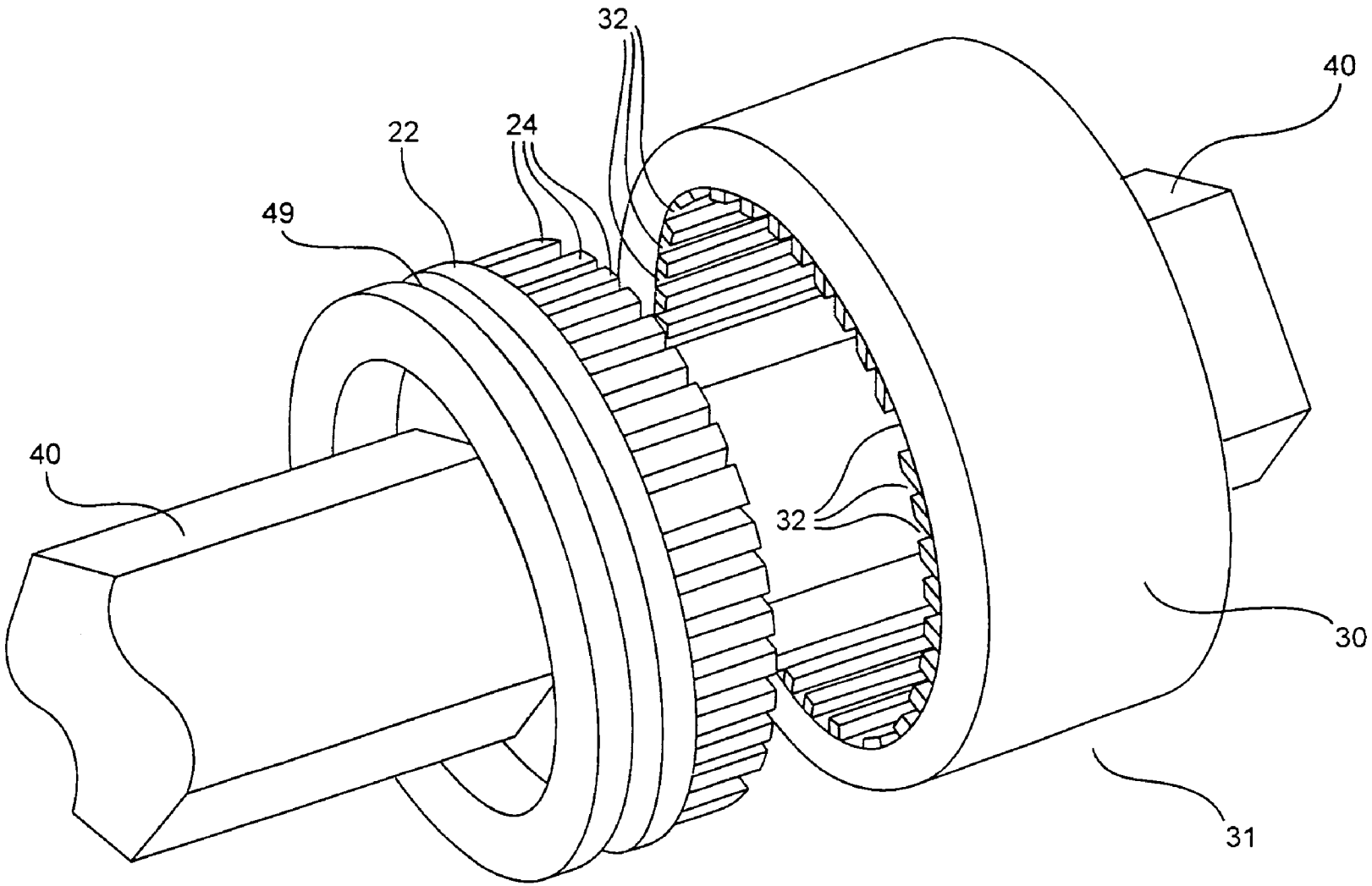
Figure 4D:
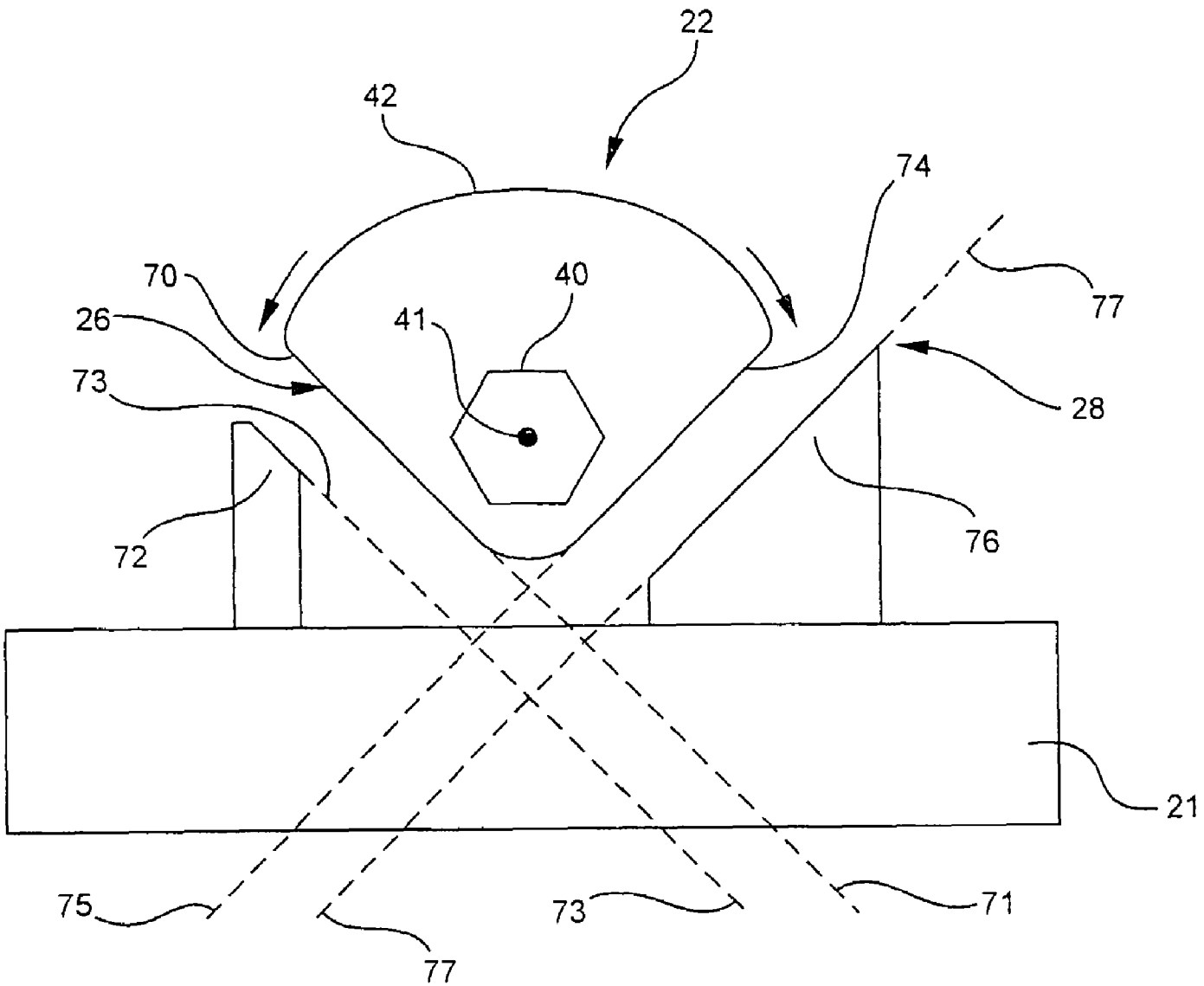
Figure 4E:
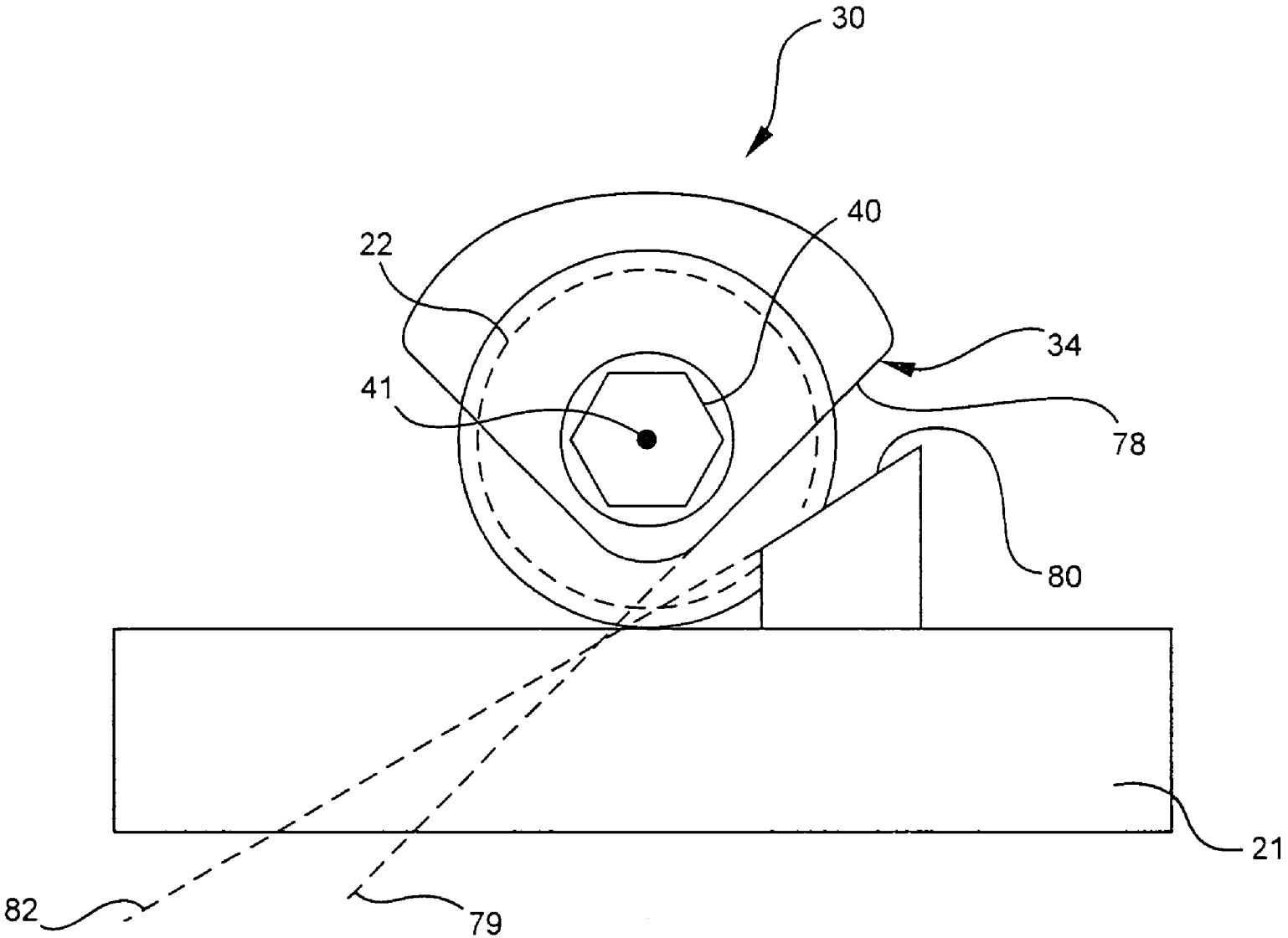
Figure 4F:
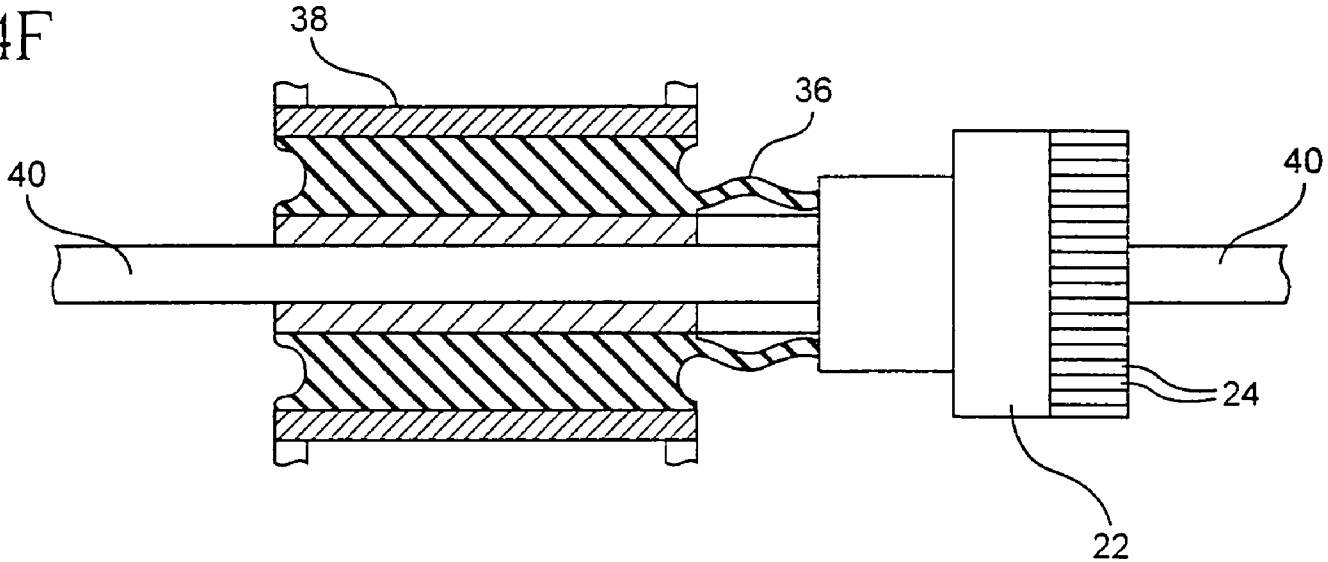
Figure 4H:
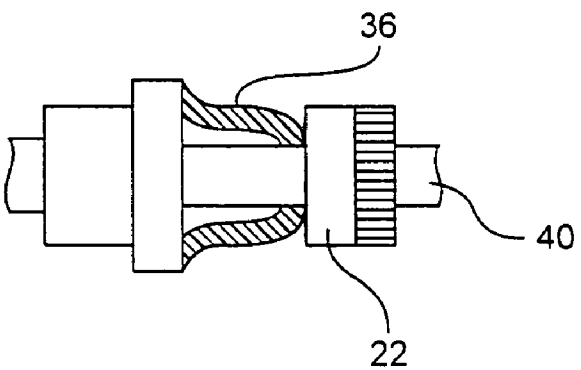
Figure 4G:
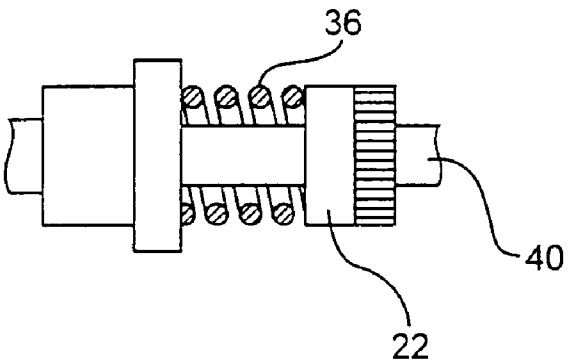
Figure 4I:
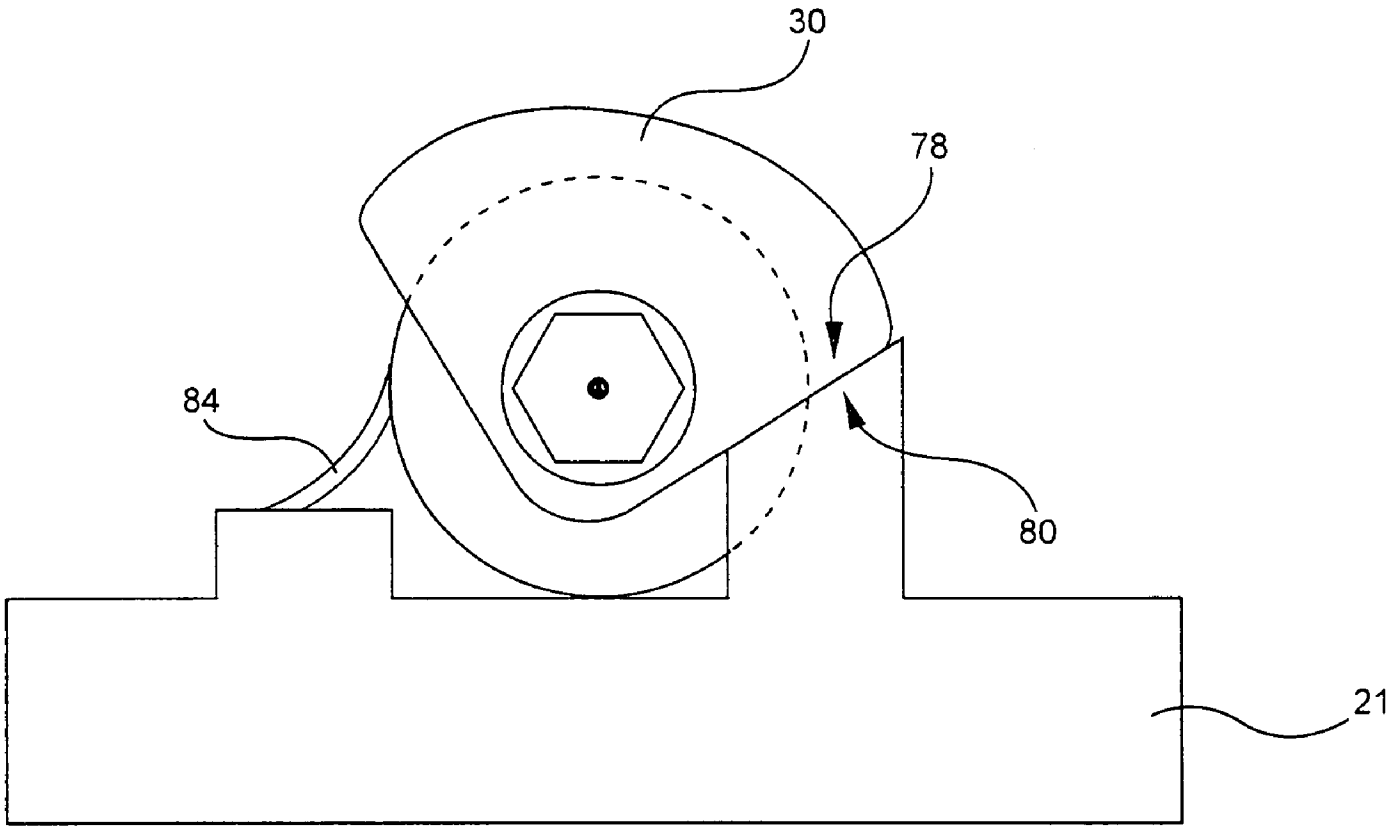
Figure 4J:
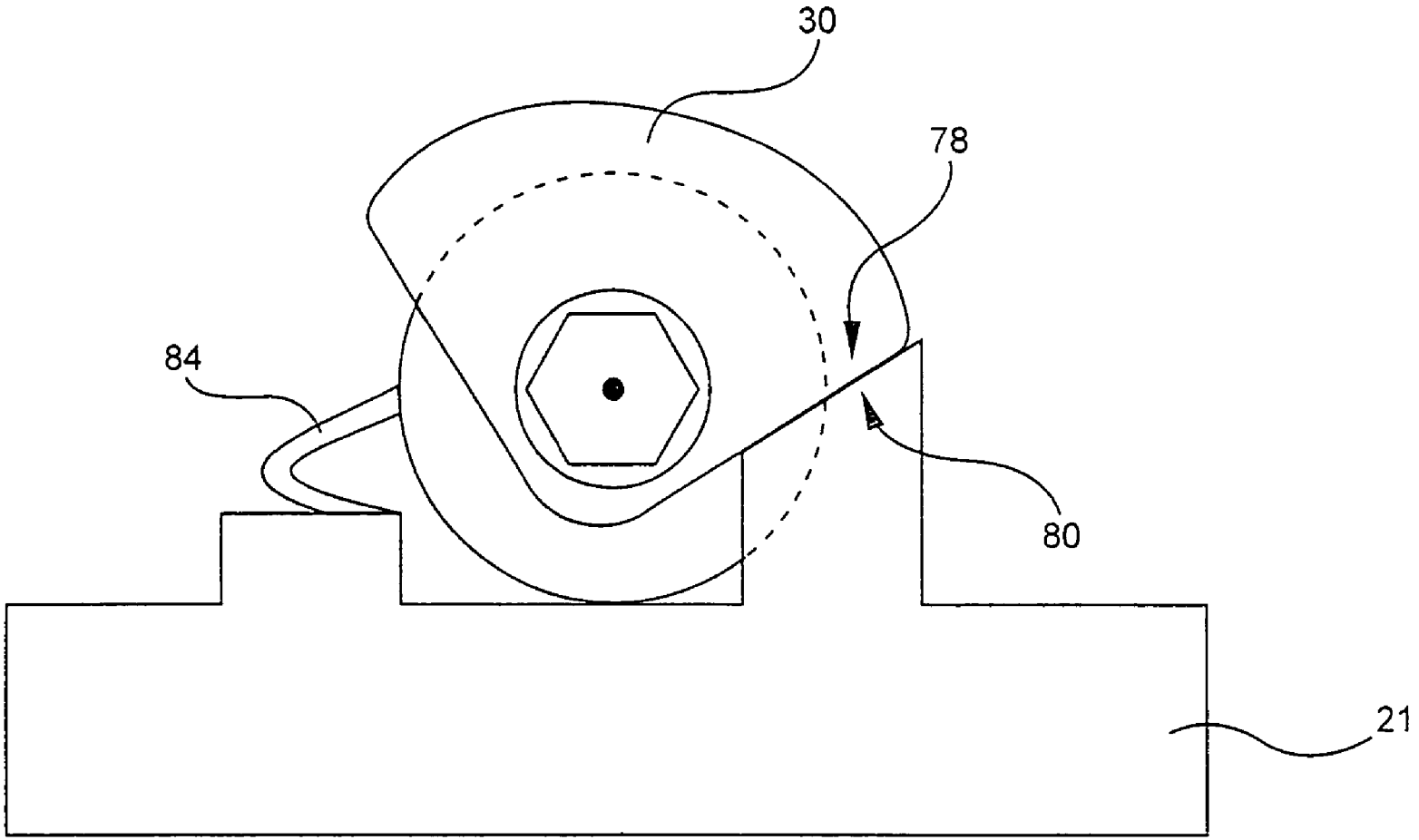
Figure 4K:
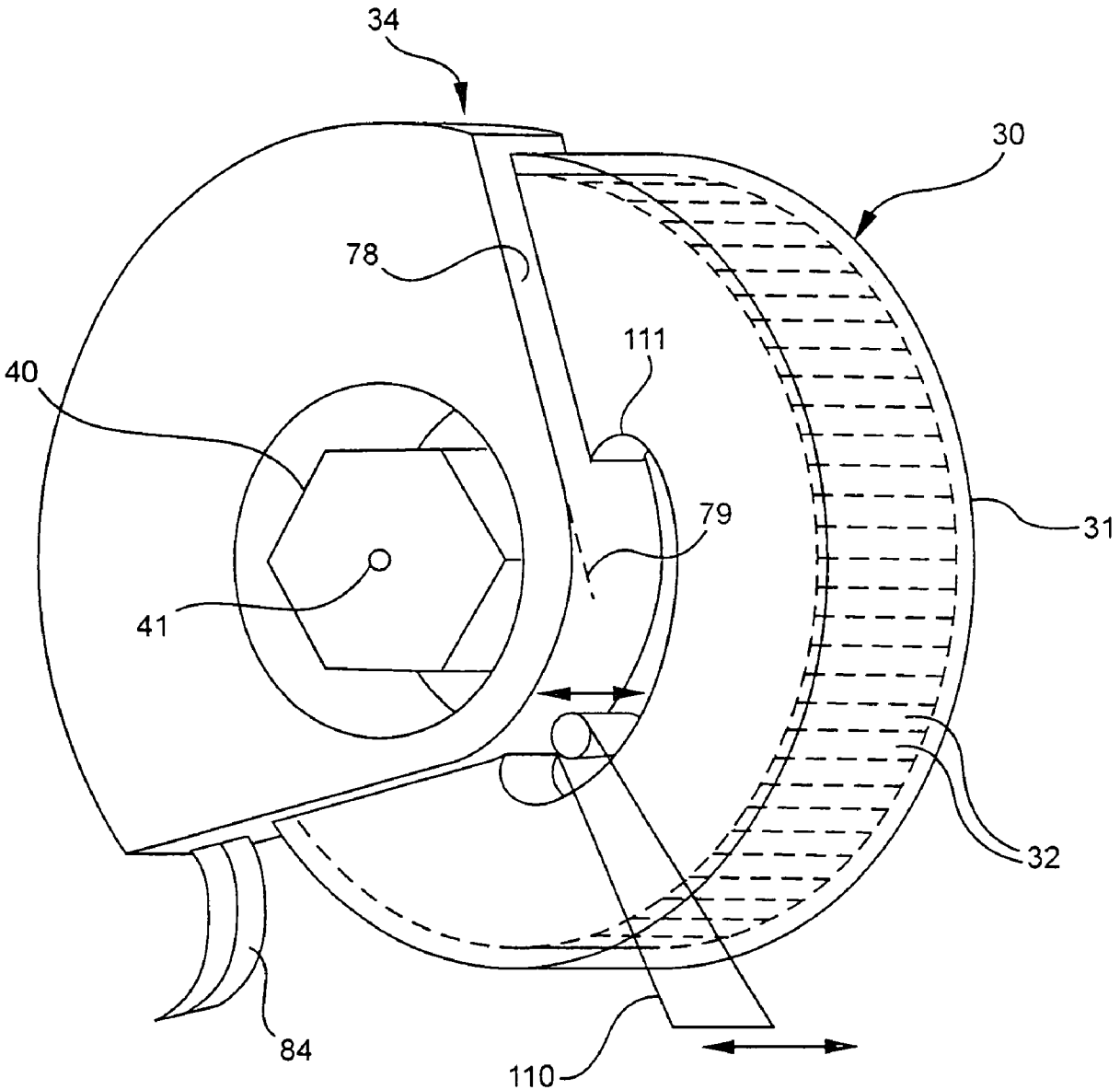
Figure 4L:
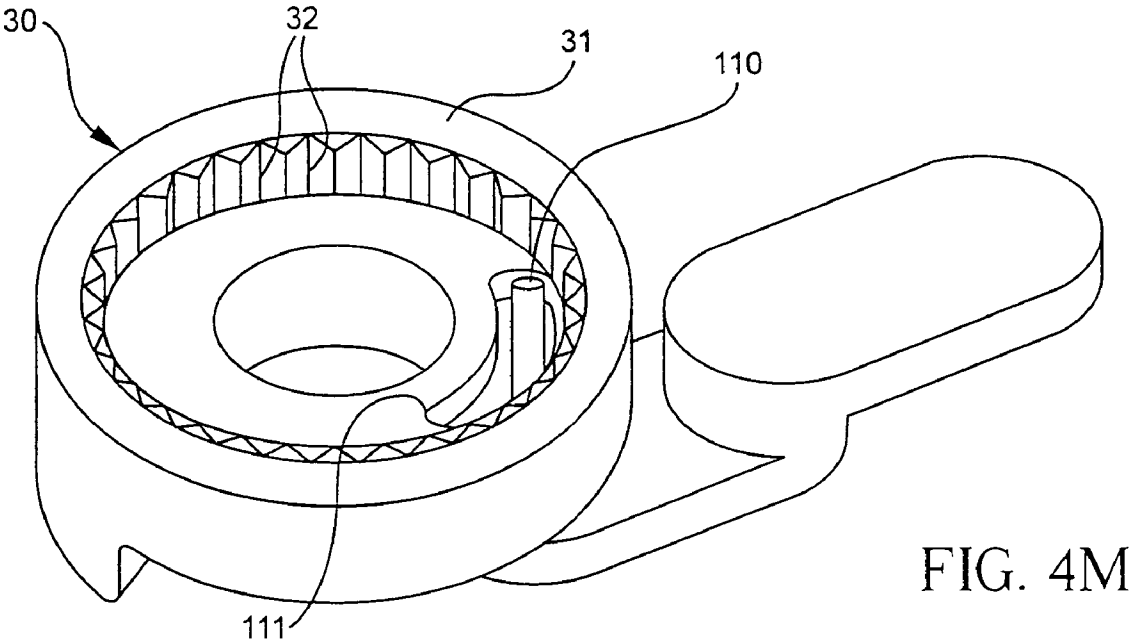
Figure 4M:
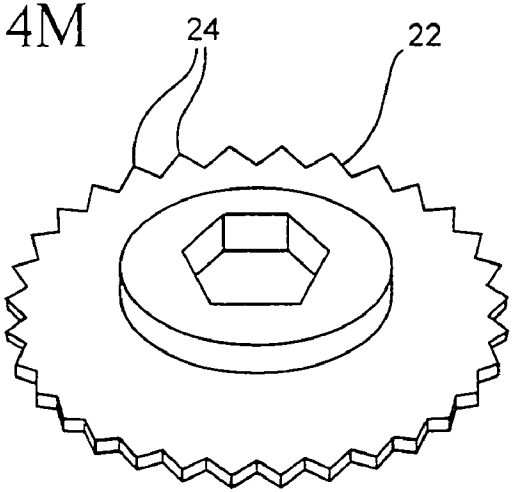
Figure 4N:
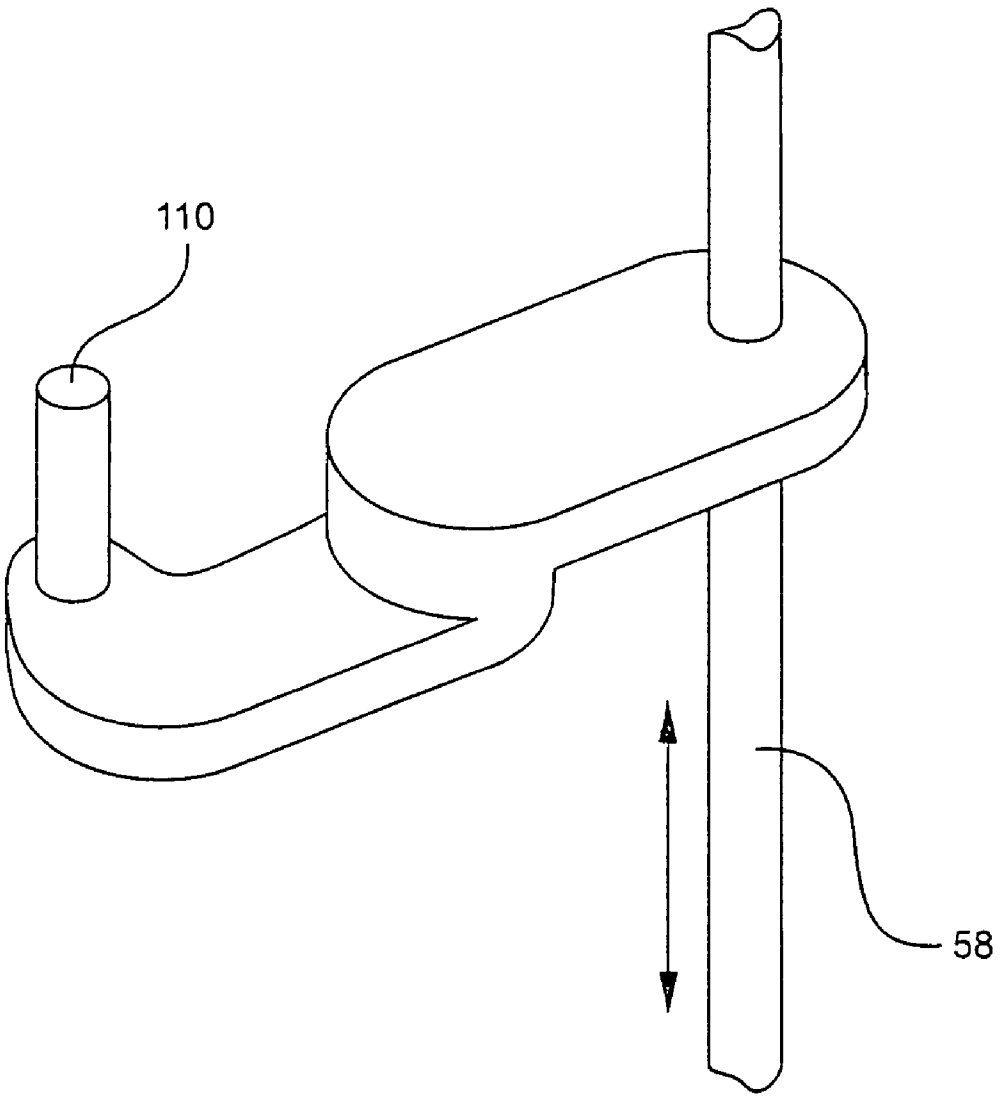
Figure 4O:
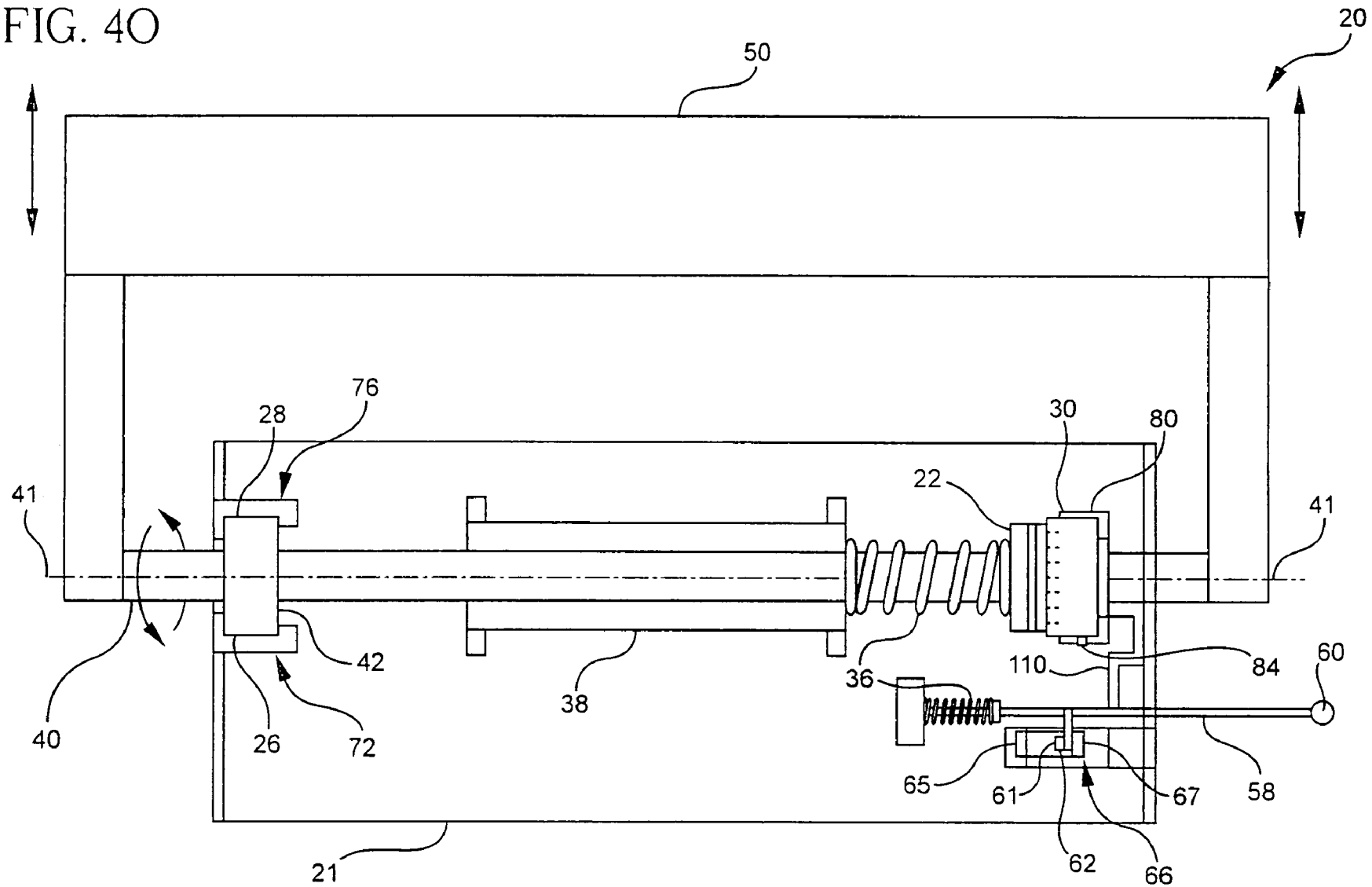
Figure 4P:
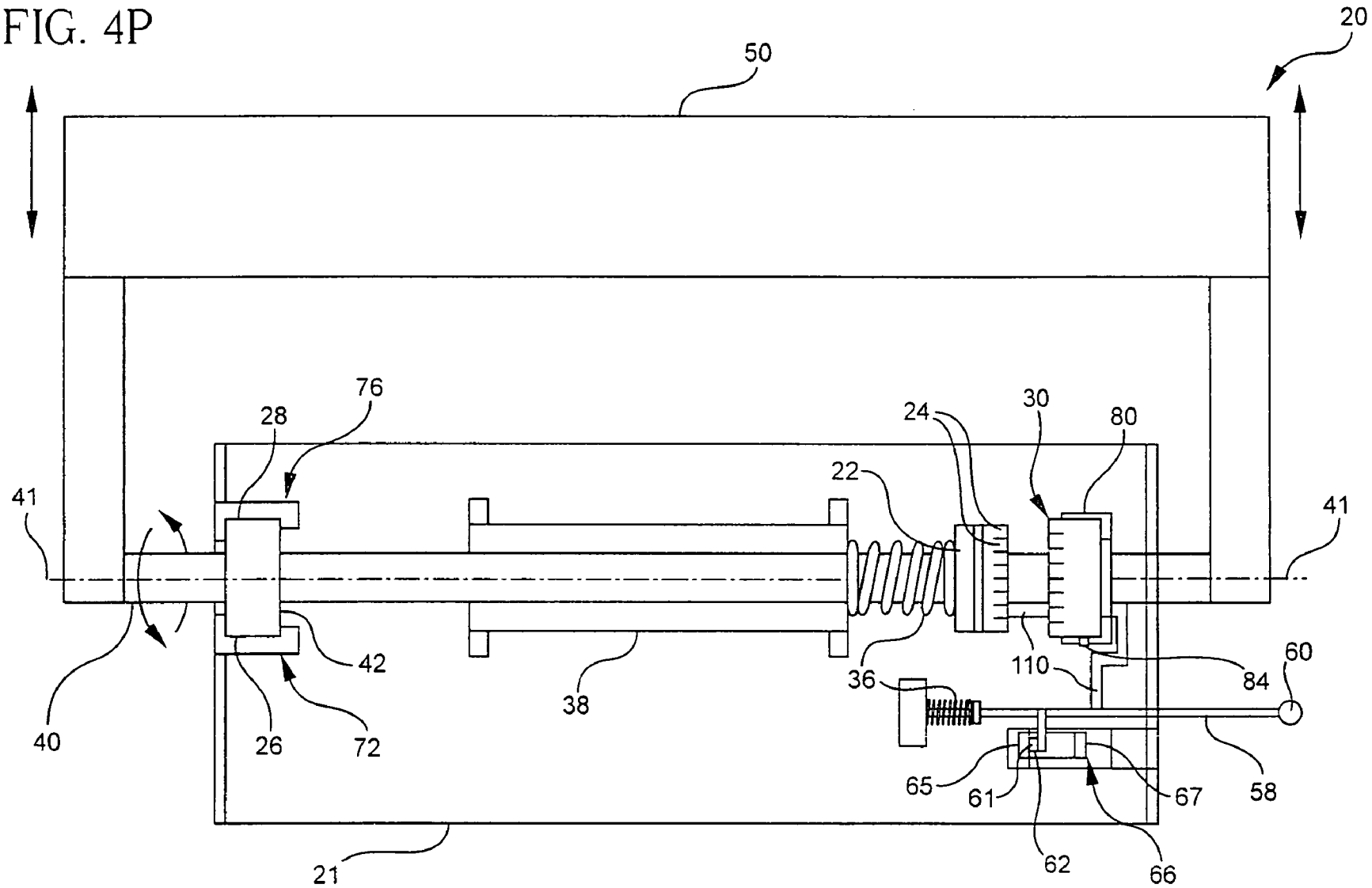
Figure 5:
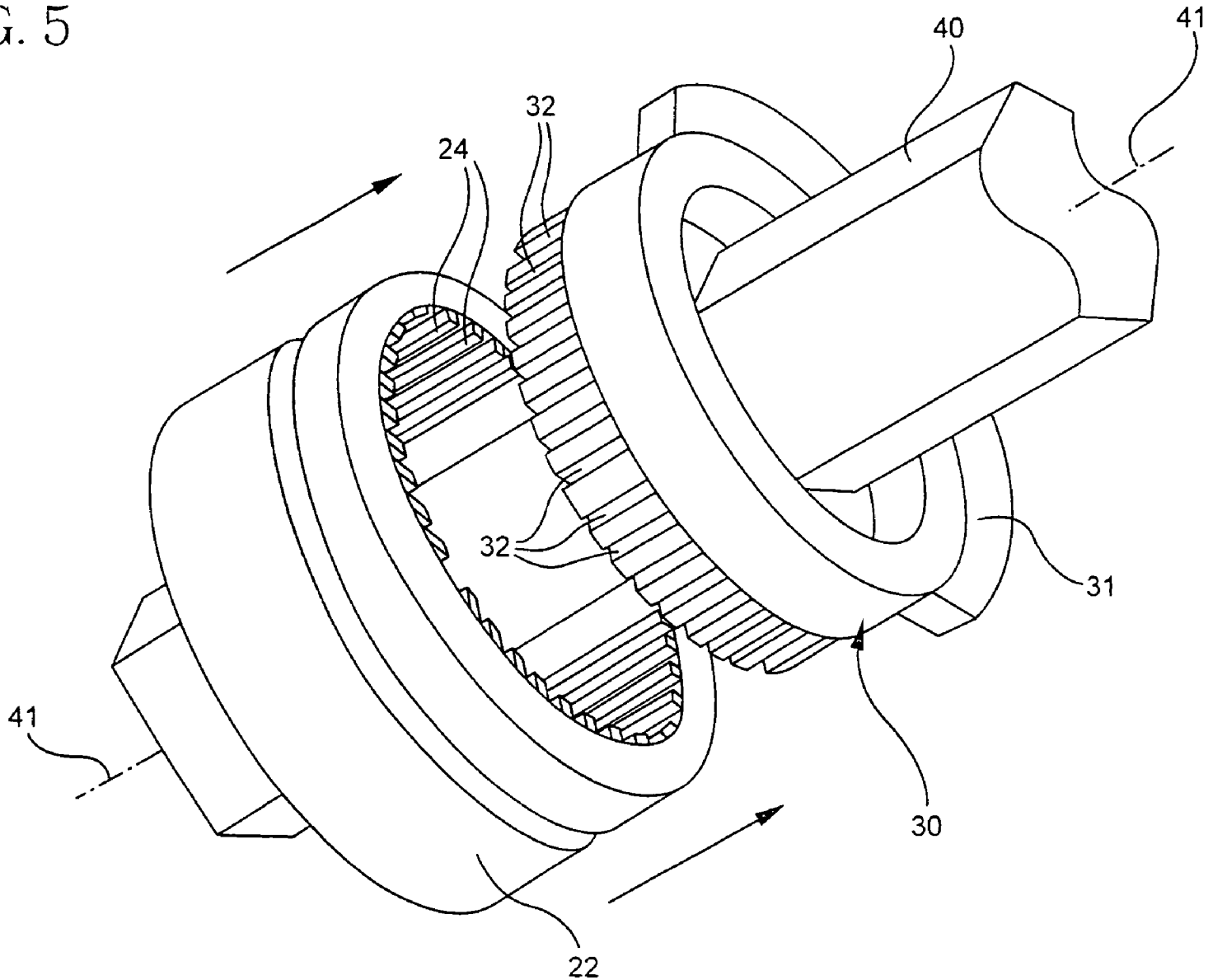
FIG. 5 shows an embodiment of the invention.
Figure 8:
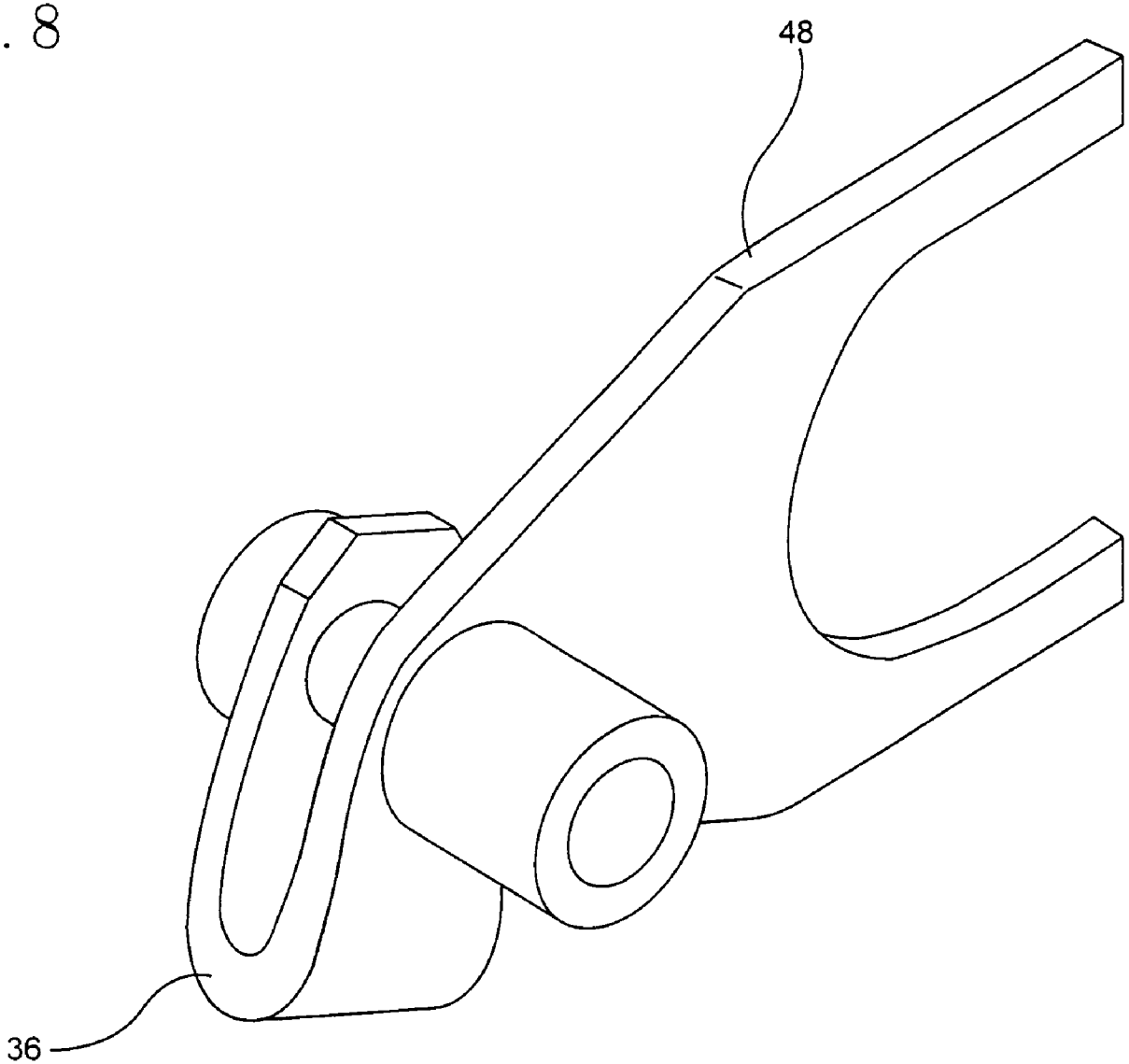
FIG. 8 shows an embodiment of the invention.
Figure 9A:
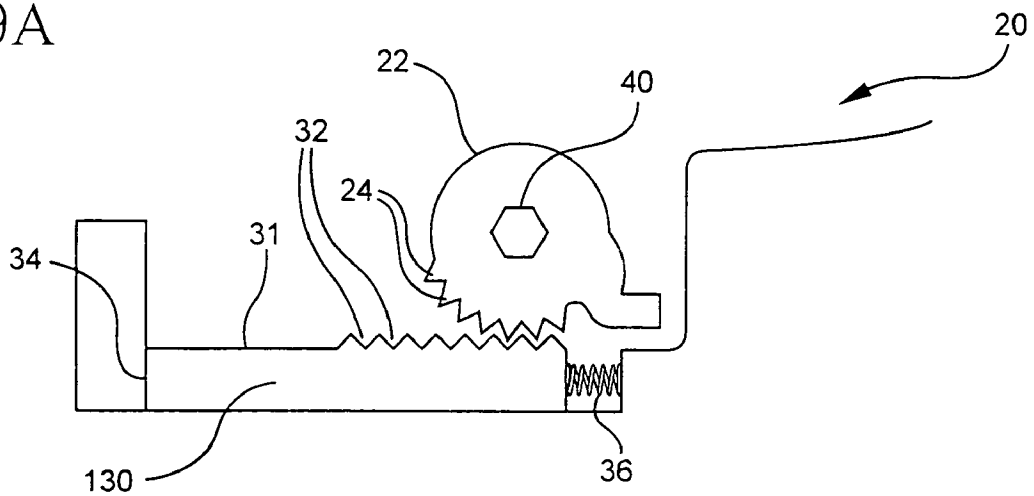
FIG. 9*a-d* shows an embodiment of the invention.
Figure 9B:
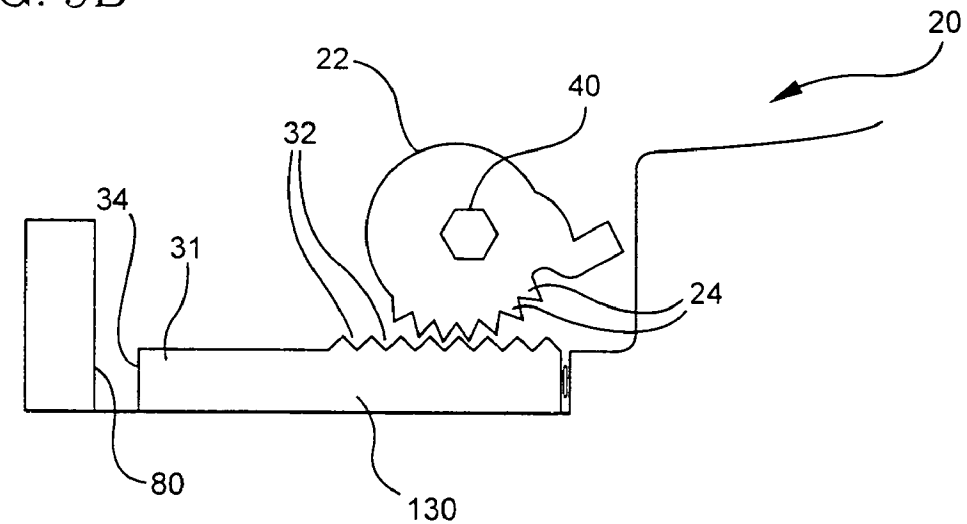
Figure 9C:
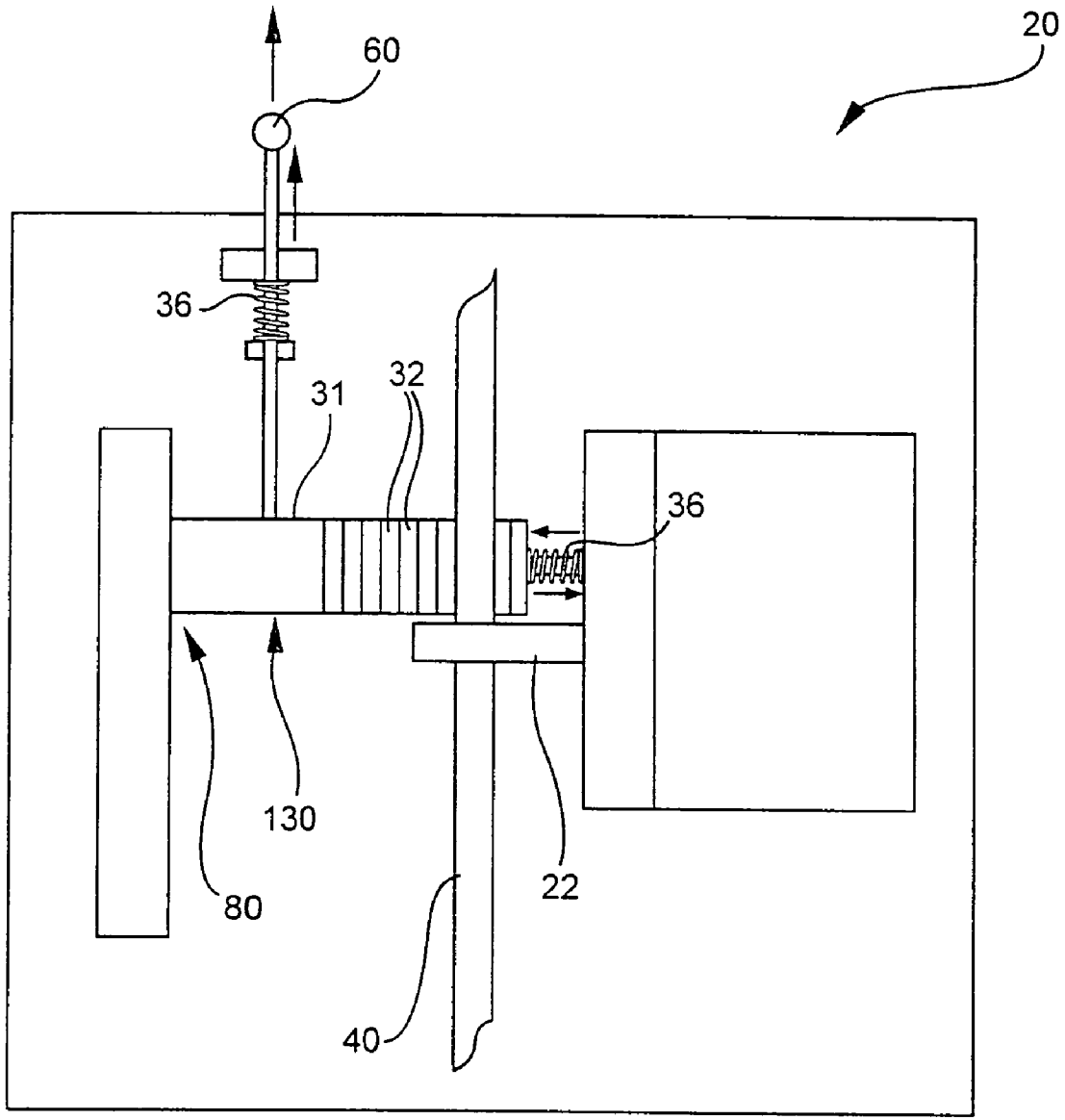
Figure 9D:
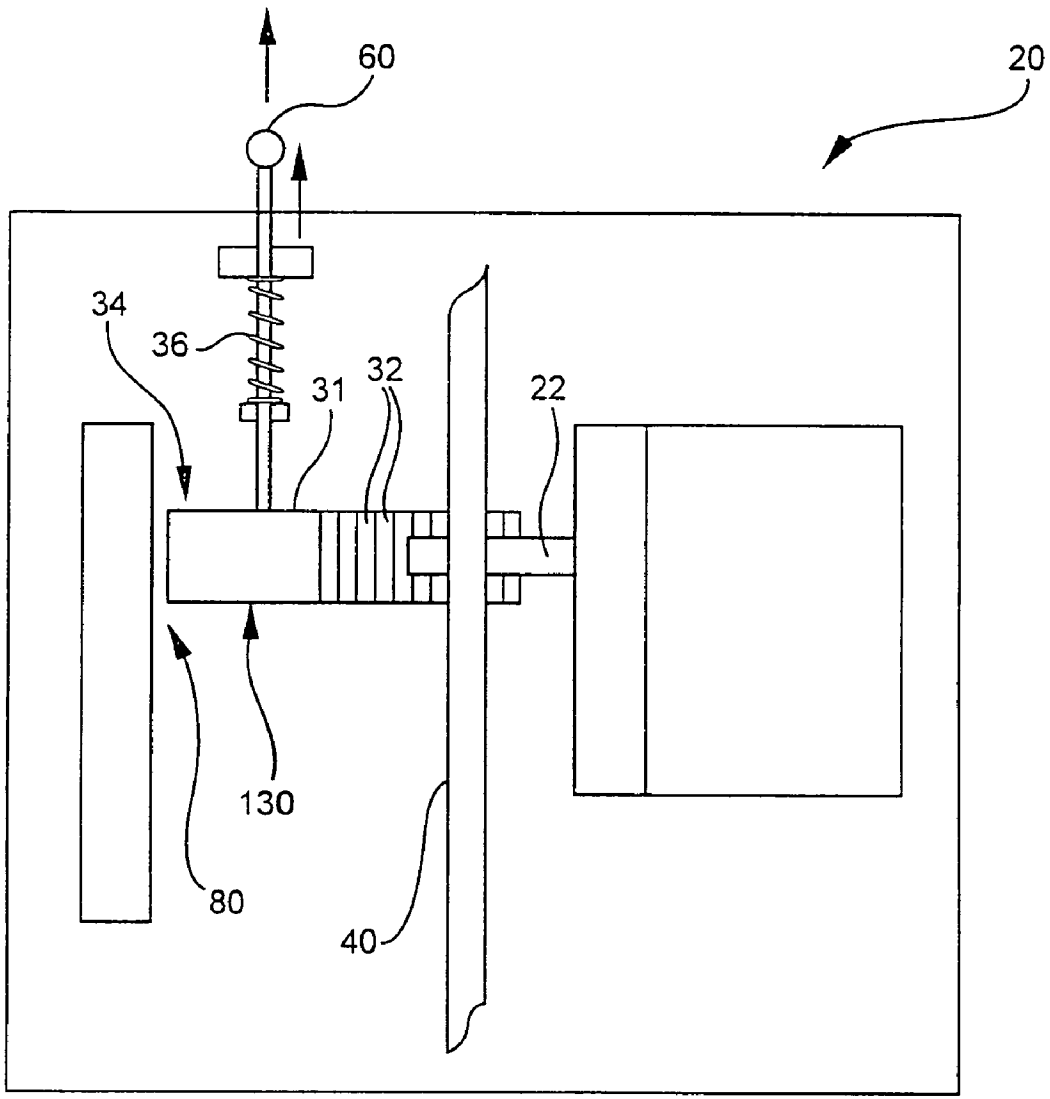

Reference will now be made in detail to the present preferred embodiments of the invention, examples of which are illustrated in the accompanying Drawings. The invention includes a seatback tilt angle limiter for adjustably limiting the recline angle of a seatback. As shown in FIG. 1, the seatback tilt limiter 20 provides for controlling the recline tilt angle of seatback 50. The seatback tilt limiter 20 is comprised of a first rotator 22 with repeating periodic protrusions teeth 24. The first rotator 22 has a full forward seatback upright endstop 26 and a full recline seatback endstop 28. The seatback tilt limiter 20 is comprised a second rotator 30 with repeating periodic receivers teeth 32. Second rotator 30 has an adjustment endstop 34. The first rotator periodic protrusions teeth 24 are disengagably received by the second rotator teeth receivers 32, wherein the first rotator 22 is free to rotate between the full forward seatback upright endstop 26 and the full recline seatback endstop 28 when the protrusions teeth 24 are disengaged and not received in the second rotator receivers 32 and the second rotator adjustment endstop 34 limits the rotation of the first rotator 22 to an adjustable reclined seatback tilt limit 44 when the toothed protrusions 24 are received is the second rotator toothed receivers 32. The tilt limiter includes a control switch 60 for controlling engagement and disengagement of toothed rotator 22 and 30. The tilt limiter includes a control switch engagement disengagement linkage fork member 48 for engagement and disengagement of toothed rotator 22 and 30. The control switch 60 is linked to rotator 22 with the linkage fork member 48, preferably with the rotator 22 having a linkage fork receiving slot 49, wherein the linkage fork member is able to urge engagement and disengagement of rotator 22 while allowing rotation of the rotator 22 with shaft 40. As shown in FIG. 8, in an embodiment control switch engagement disengagement linkage fork member 48 includes resilient member 36, with linkage fork member 48 having an integrated bushing and spring feature structure to provide for bias positioning of the linkage member such as a molded in integral leaf spring resilient member 36. Preferably the tilt limiter control switch 60 for controlling engagement and disengagement of the protrusions in the receivers is a magnetic control switch. As shown in FIG. 4, preferably magnetic control switch 60 has a magnetic anchor 62, with the magnetic anchor 62 having a seatback tilt adjustment position 64 wherein the magnetic anchor 62 inhibits engagement of the protrusions 24 in the receivers 32 when the magnetic anchor 62 is in the seatback tilt adjustment position 64. Preferably the magnetic control switch 60 magnetic anchor 62 has a seatback limited tilt position 66 wherein the magnetic anchor inhibits disengagement of the protrusions 24 from the receivers 32 when the magnetic anchor 62 is in the seatback limited tilt position 66. Preferably the seatback tilt limiter 20 includes a resilient member 36 for biasing engagement of the protrusions 24 in the receivers 32. As shown in FIG. 4 the resilient member 36 for biasing engagement of the protrusions 24 in the receivers 32 is preferably positioned along shaft 40 between a torsion bushing 38 that torsionally couples hex shaft 40 to the stationary housing 21. In a preferred embodiment resilient member 36 is a lateral spring that is molded as part of the elastomer of the torsion bushing 38 so that it protrudes from the side of the bushing towards rotator 22. In an embodiment resilient member 36 is a molded in compression spring and bushing positioned along shaft 40 to urge rotator 22 towards rotator 30. In an embodiment resilient member 36 is a molded-in lateral spring and bushing positioned along shaft 40 to urge rotator 22 towards rotator 30. Preferably the first rotator 22 is comprised of a rotating coupled shaft 40 and an end stop member 42 in that the protrusions 24, hex shaft 40, and first rotator end stop member 42 are coupled together to rotate as one. Preferably the first rotator 22, shaft 40, and end stop member 42 have a center axis of rotation 41. The center axis of rotation 41 is preferably the center of rotating hex shaft 40, with the center axis of rotation of first rotator 22 and its end stop member 42 being based on the hex shaft center axis. Preferably the first rotator full forward seatback upright endstop 26 having an offcenter nonradial endstop contact surface 70 for endstop contact with a housing full forward endstop contact abutment surface 72. The housing full forward endstop contact abutment surface 72 has a nonradial extension 73 which does not intersect the center of rotation 41 or the hex shaft 40. Preferably the first rotator full recline seatback endstop 28 has an offcenter nonradial endstop contact surface 74 for endstop contact with a housing full recline seatback endstop contact abutment surface 76. The housing endstop contact abutment surface 76 has a nonradial extension 77 which does not intersect the center of rotation 41 or the hex shaft 40. The first rotator full forward seatback upright endstop offcenter nonradial endstop contact surface 70 has a nonradial extension 71 which does not intersect the center of rotation 41 or the hex shaft 40. The first rotator full recline seatback endstop offcenter nonradial endstop contact surface 74 has a nonradial extension 75 which does not intersect the center of rotation 41 or the hex shaft 40. The second rotator 30 has a center axis of rotation 41 about hex shaft 40 and the second rotator adjustment endstop 34 has an offcenter nonradial endstop contact surface 78 for endstop contact with a housing adjustment endstop contact abutment surface 80. The second rotator adjustment endstop offcenter nonradial endstop contact surface 78 has a nonradial extension 79 which does not intersect the center of rotation 41 or the hex shaft 40. The housing endstop contact abutment surface 80 has a nonradial extension 82 which does not intersect the center of rotation 41 or the hex shaft 40. FIG. 4*k-p* shows a preferred embodiment of second rotator 30 and a preferred embodiment of the invention with an engagement disengagement linkage pusher member 110 for engagement and disengagement of toothed rotator 22 and 30. The second rotator 30 has a pusher orifice passageway for receiving the pusher end of pusher member 110 and allowing the pusher 110 to push the first rotator 22 out of the second rotator 30 for engagement and disengagement of toothed rotator 22 and 30. The control switch 60 is linked with the linkage member 110, wherein the linkage pusher member 110 is able to urge disengagement of rotator 22 with resilient member 36 biasing engagement of rotator 22 into rotator 30. When the pusher 110 disengages the first rotator 22 out of the second rotator 30 a resilient spring member 84 biases the contact surface 78 of endstop 34 of second rotator 30 into contact abutment with housing abutment 80, with first rotator 22 being rotated with shaft 40 to the adjustment recline angle 44 with the seatback 50, then the pusher member 110 is withdrawn back through the passageway 111 with the control switch 60 to allow the now rotated to adjustment recline angle first rotator 22 to re-enter into the second rotator 30 so that the contact surface 78 of endstop 34 of second rotator 30 abutting the housing abutment 80 provides the adjustment endstop limit 34 at the recline angle 44 for the seatback 50. Second rotator 30 is free to rotate relative to hex shaft 40 when second rotator 30 and the first rotator 22 are disengaged. When second rotator 30 and first rotator 22 are engaged the rotation of second rotator 30 is linked to hex shaft 40 through the first rotator 22, with endstop 34 and its contact surface 78 providing a physical endstop to limit the tilt of seatback 50. Preferably second rotator 30 has a spring member that rotate returns the rotator to a home reference position, preferably with contact abutment surfaces 78 and 80 urged together. As shown in FIG. 4*i-j*, spring member 84 abuts the housing 21 and urges the rotation of second rotator 30 towards the adjustable endstop 34 position with endstop contact Surface 78 contacting housing abutment surface 80, with such spring member reference positioning of the second rotator providing a preferred rotation orientation of the second rotator when the protrusions teeth of the first rotator 22 are disengaged and not received by the second rotator 30 such as shown FIG. 4*b-c* when the magnetic anchor 62 is in seatback tilt adjustment position 64 during the adjusting of the tilt limit of the seatback 50. Preferably the spring member 84 is an integral molded spring made during the mold forming of the rotator 30, most preferably when the rotator 30 is a molded plastic rotator with spring member 84 part of the plastic molding. FIG. 1-4 show embodiments of the seatback tilt limiter 20 that provide an adjustable reclined tilt angle for seatback 50 utilizing first and second toothed rotators 22 and 30. Preferably the rotation of the engaged first and second toothed rotators 22 and 30 is coupled and fixed to the shaft 40 which is directly or rigidly coupled to the chair tilt pivot of seatback 50 to provide the adjustable recline angle 44.

The invention includes a method of adjusting a tilt limit of a seatback 50. The method includes providing a first toothed rotator 22. Preferably the first toothed rotator 22 has repeating periodic protrusions/receivers. Preferably the first toothed rotator 22 has a full forward seatback upright endstop 26 and a full recline seatback endstop 28. The invention includes providing a second toothed rotator 30 meshed to the first toothed rotator 22. Preferably the second toothed rotator 30 has repeating periodic protusions/receivers that correspond with the repeating periodic protrusions/receivers of the first toothed rotator 22 to provide a meshed gear system. Provided second toothed rotator 30 preferably has an adjustment endstop 34. The method includes disengaging the first toothed rotator 22 from the second toothed rotator 30, positioning the seatback 50 to an adjustable reclined seatback tilt limit 44 between the full forward seatback upright endstop and the full recline seatback endstop with the first toothed rotator 22 rotated relative to the second toothed rotator 30, engaging the first toothed rotator 22 with the second toothed rotator 30 wherein the seatback 50 is limited to tilting between the full forward seatback upright endstop 26 and the adjustable reclined seatback tilt limit 44 by adjustment endstop 34 of second toothed rotator 30. Preferably the method includes providing a magnetic control switch 60. Preferably the magnetic control switch 60 has a magnetic anchor 62 with a seatback tilt adjustment position 64 and a seatback limited tilt position 66, and positioning the magnetic anchor 62 at the seatback tilt adjustment position 64 to disengage the first toothed rotator 22 from the second toothed rotator 30 and positioning the magnetic anchor 62 at the seatback limited tilt position 66 to engage the first toothed rotator 22 with the second toothed rotator 30. Preferably disengaging the first toothed rotator 22 from the second toothed rotator 30 includes compressing a resilient member 36 which biases engagement of the first toothed rotator 22 with the second toothed rotator 30.

The invention includes a method of making a seatback tilt limiter 20 for adjustably limiting the recline of a seatback 50. The method includes providing a first toothed rotator 22 with repeating periodic protrusions/receivers 24 and having a full forward seatback upright endstop 26 and a full recline seatback endstop 28. The method includes providing a second toothed rotator 30 with repeating periodic protrusions/receivers 32 and having an adjustment endstop 34. The method includes providing a resilient member 36 for biasing an engagement of the first toothed rotator 22 with the second toothed rotator 30, disenable coupling the first toothed rotator 22 and the second toothed rotator 30 with the resilient member wherein a compression of the resilient member 36 permits the first toothed rotator 22 and the second toothed rotator 30 to disengage to provide for relative rotation between the first toothed rotator 22 and the second toothed rotator 30 to establish an adjusted seatback tilt limit 44 between full forward seatback upright endstop and the full recline seatback endstop with the adjustment endstop 34. Preferably the method includes providing a magnetic control switch 60 having a magnetic anchor 62 with a seatback tilt adjustment position 64 for maintaining the compression of the resilient member. Preferably the magnetic control switch 60 has a seatback limited tilt position 66 wherein the magnetic anchor inhibits disengagement of the toothed rotators 22 and 30 when the magnetic anchor 62 is in the seatback limited tilt position 66. Preferably the first toothed rotator 22 is a gear and the second toothed rotator 30 is a second gear. Preferably the first toothed rotator 22 is an inner member and the second toothed rotator 30 is an outer member with inner member first toothed rotator 22 received inside the outer member second toothed rotator 30. In an alternative embodiment the first toothed rotator 22 is an outer member and the second toothed rotator 30 is an inner member with the inner member second toothed rotator 30 received inside the outer member first toothed rotator 22. Preferably the first rotator 22 has a center axis of rotation 41 about the hex shaft 40 center axis with the first rotator forward seatback upright endstop 26 having an offcenter nonradial endstop contact surface 70 for endstop contact with housing full forward endstop contact abutment surface 72 with the housing full forward endstop contact abutment surface having a nonradial extension 73 which does not intersect the center of rotation 41 or the shaft 40. Preferably the first rotator 22 has a center axis of rotation 41 about the hex shaft 40 and the first rotator recline seatback endstop 28 having an offcenter nonradial endstop contact surface 74 for endstop contact with housing recline seatback endstop contact abutment surface 76 with the housing endstop contact abutment surface 76 having a nonradial extension 77 which does not intersect center of rotation or the shaft. Preferably the nonradial extensions 77 and 73 intersect at an intersection point outside of the rotator 22 and the axle 40. Preferably the nonradial extensions 71 and 75 of the offcenter nonradial endstop contact surface 70 and offcenter nonradial endstop contact surface 74 intersect at an intersection point outside of the rotator 22 and the axle 40. Preferably the second rotator 30 has a center axis of rotation 41 about the hex shaft 40 and the second rotator adjustment endstop 34 has an offcenter nonradial endstop contact surface 78 for endstop contact with housing adjustment endstop contact abutment surface 80 with the housing endstop contact abutment surface 80 having a nonradial extension 82 which does not intersect center of rotation or the shaft.

The invention includes a method of making a seatback tilt limiter for adjustably limiting the recline of a seatback between a seatback forward upright endstop and a seatback full recline endstop. The method includes providing a first toothed rotator gear member with a plurality of repeating periodic gear teeth. The method includes providing a second toothed gear member with a plurality of repeating periodic gear teeth and having an adjustment endstop and disengagably coupling the first toothed rotatol gear member repeating periodic gear teeth with the second toothed gear member repeating periodic gear teeth wherein the second toothed gear member adjustment endstop provides an adjustable recline angle seatback endstop between the seatback forward upright endstop and said seatback full recline endstop. The method includes making a seatback tilt limiter 20 for adjustably limiting the recline of a seatback 50 between a seatback forward upright endstop 26 and a seatback full recline endstop 28. The method includes providing a first toothed rotator gear member 22 with a plurality of repeating periodic gear teeth 24. The method includes providing a second toothed gear member 31 with a plurality of repeating periodic gear teeth 32 and having an adjustment endstop 34 and disengagably coupling the first toothed rotator gear member repeating periodic gear teeth 24 with the second toothed gear member repeating periodic gear teeth 32 wherein the second toothed gear member adjustment endstop 34 provides an adjustable recline angle 44 seatback endstop between the seatback forward upright endstop 26 and said seatback full recline endstop 28. In preferred embodiments of the invention Such as shown in FIG. 2-5, providing a second toothed gear member 31 with a plurality of repeating periodic gear teeth 32 and an adjustment endstop 34 includes providing a rotating gear member second rotator 30. In an alternative embodiment of the invention such as shown in FIG. 9, providing a second toothed gear member 31 with a plurality of repeating periodic gear teeth 32 and an adjustment endstop 34 includes providing a sliding linear gear member 130. As shown in the side views of FIG. 9*a-b,* the sliding lineal gear adjustment endstop 34 abuts the housing abutment contact surface 80 wherein the sliding linear gear second toothed gear member adjustment endstop 34 provides an adjustable recline angle 44 seatback endstop between the seatback forward upright endstop 26 and said seatback full recline endstop 28. As shown in the top views of FIG. 9*c-d,* the sliding linear gear 130 slides along the longitudinal direction of shaft 40 to disengage it from the first toothed rotator gear member 22 to allow adjustment of the recline angle 44 between the seatback forward upright endstop 26 and the seatback full recline endstop 28 by rotation of first toothed rotator gear member 22. Preferably a resilient spring member 36 biases the endstop 34 against the housing abutment contact surface 80 during disengagement.

The invention includes a seatback tilt angle limiter 20 for limiting the tilt angle recline of a seatback 50. The seatback tilt angle limiter is comprised of a housing endstop contact abutment surface and a rotator. The seatback tilt angle limiter rotator has a seatback endstop and a center axis of rotation about a shaft with the rotator seatback endstop having an offcenter nonradial endstop contact surface for endstop contact with the housing endstop contact abutment surface with the housing endstop contact abutment surface having a nonradial extension wherein an extension of the housing endstop contact abutment surface does not intersect the shaft with the contact surface having an offcenter orientation relative to the shaft and center of rotation. The seatback tilt angle limiter 20 has a housing endstop contact abutment surface and a rotator. The seatback tilt angle limiter rotator has a seatback endstop 28 and a center axis of rotation about a shaft 40 with the rotator seatback endstop 28 having an offcenter nonradial endstop contact surface 74 for endstop contact with the housing endstop contact abutment surface 76 with the housing endstop contact abutment surface 76 having a nonradial extension 77 wherein an extension 77 of the housing endstop contact abutment surface does not intersect the shaft 40 with the contact surface having an offcenter orientation relative to the shaft 40 and the center of rotation. Preferably the seatback tilt angle limiter 20 has a second housing endstop contact abutment surface 72 and the rotator 22 has a second seatback endstop 26 with a second offcenter nonradial endstop contact surface 70 for endstop contact with the second housing endstop contact abutment surface 72 with the second housing endstop contact abutment surface having a nonradial extension 73 wherein an extension 73 of the second housing endstop contact abutment surface does not intersect the shaft 40 and the contact surface has an offcenter orientation relative to the shaft 40 and center of rotation 41. Preferably the seatback tilt limiter 20 is comprised of an adjustment housing endstop contact abutment surface 80 and a second rotator 30 having an adjustment seatback endstop 34 and a center axis of rotation about the shaft 40, with the adjustment seatback endstop 34 having an adjustment offcenter nonradial endstop contact surface 78 for endstop contact with the adjustment housing endstop contact abutment Surface 80 with the adjustment housing endstop contact abutment surface having a nonradial extension 82 wherein an extension 82 of the adjustment housing endstop contact abutment surface does not intersect the shaft and the contact surface has an offcenter orientation relative to the shift and center of rotation.

The invention includes a method of making a furniture seat tilt angle limiter. The invention includes providing a housing endstop contact abutment surface, providing a rotator having a seatback endstop and a center axis of rotation about a shaft, with the rotator seatback endstop having an offcenter nonradial endstop contact surface for endstop contact with the housing endstop contact abutment surface, positioning the rotator proximate the housing endstop contact abutment surface wherein the housing endstop contact abutment surface has an offcenter orientation with the rotator center of rotation with an extension of the housing endstop contact abutment surface not intersecting the shaft with the contact surface oriented nonradially. The housing endstop contact abutment Surface 76 and the rotator 22 with seatback endstop 28 and center axis of rotation 41 about shaft 40 are positioned together to provide a hard endstop. The rotator seatback endstop 28 has an offcenter nonradial endstop contact surface 74 positioned proximate the housing endstop contact abutment surface 76 wherein the housing endstop contact abutment Surface 76 has an offcenter orientation with the rotator center of rotation 41 with an extension 77 of the housing endstop contact abutment surface 76 not intersecting the shaft 40 with the contact surfaces oriented nonradially to the shaft and center of rotation. Preferably the method includes providing shaft 40, providing an adjustment housing endstop contact abutment surface 80 and a second rotator 30 having an adjustment seatback endstop 34 and a center axis of rotation 41 about the shaft 40, disengagably coupling the first rotator 22 having the seatback endstop and the center axis of rotation through the shaft to the second rotator 30 having the adjustment seatback endstop with the adjustment housing endstop contact abutment surface 80 having an offcenter orientation with the shaft 40 wherein the second rotator adjustment seatback endstop 34 has an offcenter nonradial adjustment endstop contact surface 78 for adjustment endstop contact with the adjustment housing endstop contact abutment surface 80 with an extension of the contact surface not intersecting the shaft 40. Preferably disengagably coupling the first rotator 22 and the second rotator 30 includes coupling the first toothed members repeating periodic protrusions/receivers 24 with the second toothed members repeating periodic protrusions/receivers 32 to provide for disengagable coupling.

Figure 6:
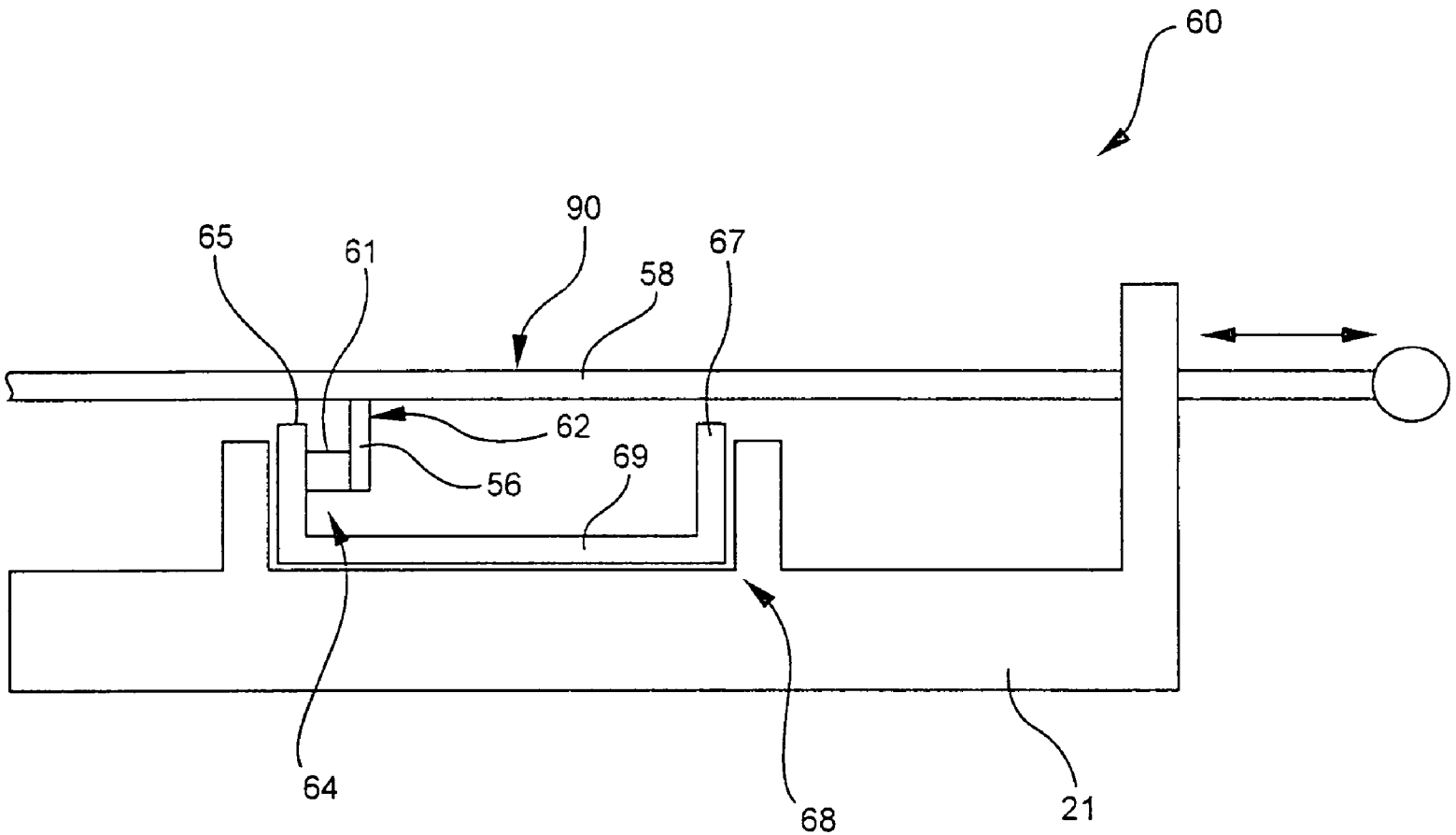
FIG. 6 shows an embodiment of the invention.

The invention includes a seatback tilt limiter magnetic control switch 60. The magnetic control switch 60 is comprised of a magnetic anchor 62, which preferably is a magnet 61. The magnetic control switch 60 is comprised of a first magnetic target 65 and a second magnetic target 67, which are prefenibly comprised of a magnetic metal attached or contained by the housing 21. The magnetic anchor 62 has a seatback tilt adjustment position 64 adjacent to the first magnetic target 65 and a seatback limited tilt position 66 adjacent to the second magnetic target 67 wherein the first magnetic attraction between the magnetic anchor 62 and the first target 65 and the second magnetic attraction between the magnetic anchor 62 and the second target 67 inhibit positioning the magnetic control switch in a neutral position between the seatback tilt adjustment position 64 and the seatback limited tilt position 66. Preferably the seatback tilt limiter magnetic control switch 60 first magnetic attraction between the magnetic anchor 62 and the first target 65 holds back the engaging resilient member 36 that biases engagement of the first and second rotators 22 and 30, with the first magnetic attraction greater than the second magnetic attraction between the magnetic anchor 62 and the second target 67, such as shown in FIGS. 4*a-b* and 6 with the magnet 61 mounted to the side of the control arm anchor 58 extension 56 of the control switch. Preferably the first target 65 and the second target 67 float within a mount constraint 68 of housing 21, such a with a U shaped magnetic metal member 69 contained with the confines of appropriately larger sized mount constraint 68. As shown in FIG. 4*b* the first magnetic attraction preferably maintains a compression of a resilient member and inhibits decompression of the compressed resilient member.

The invention includes magnetic control switch 60. The magnetic control switch 60 is comprised of a magnetic anchor 62 and a first magnetic target 65 and a second magnetic target 67, the magnetic anchor 62 having a first position 64 adjacent to the first magnetic target 65 and a second position 66 adjacent to the second magnetic target 67 wherein the first magnetic attraction between the magnetic anchor 62 and the first target 65 and a second magnetic attraction between the magnetic anchor 62 and the second target 67 inhibit positioning the magnetic control switch in a neutral position 90 between the first position 64 and the second position 66. Preferably the first magnetic attraction between magnetic anchor 62 and the first target 65 is greater than the second magnetic attraction between magnetic anchor 62 and the second target 67 with the first magnetic attraction holding back a compressed resilient member 36 and inhibiting decompression of the resilient member. Preferably the first target 65 and the second target 67 float within a mount constraint 68 of housing 21.

The invention includes a magnetic control switch 60 with the magnetic control switch comprised of a control arm 58. The control aim 58 has an engaged position 66 and a disengaged position 64 with the control arm 58 slidably fixed to a frame mount housing 21. The control switch includes a magnetic anchor 62, a first magnetic target 65 and a second magnetic target 67 wherein a first magnetic attraction between the magnetic anchor 62 and the first target 65 and a second magnetic attraction between the magnetic anchor 62 and the second target 67 inhibit positioning the control arm 58 and its anchor extension 56 in a neutral position 90 between the engaged position 66 and the disengaged position 64. Preferably the magnetic control switch includes a resilient member 36 with the resilient member biasing the control arm 58 to the engaged position 66 and the first magnetic attraction between the magnetic anchor 62 and the first target 65 is greater than the second magnetic attraction with the second target 67.

Figure 7A:
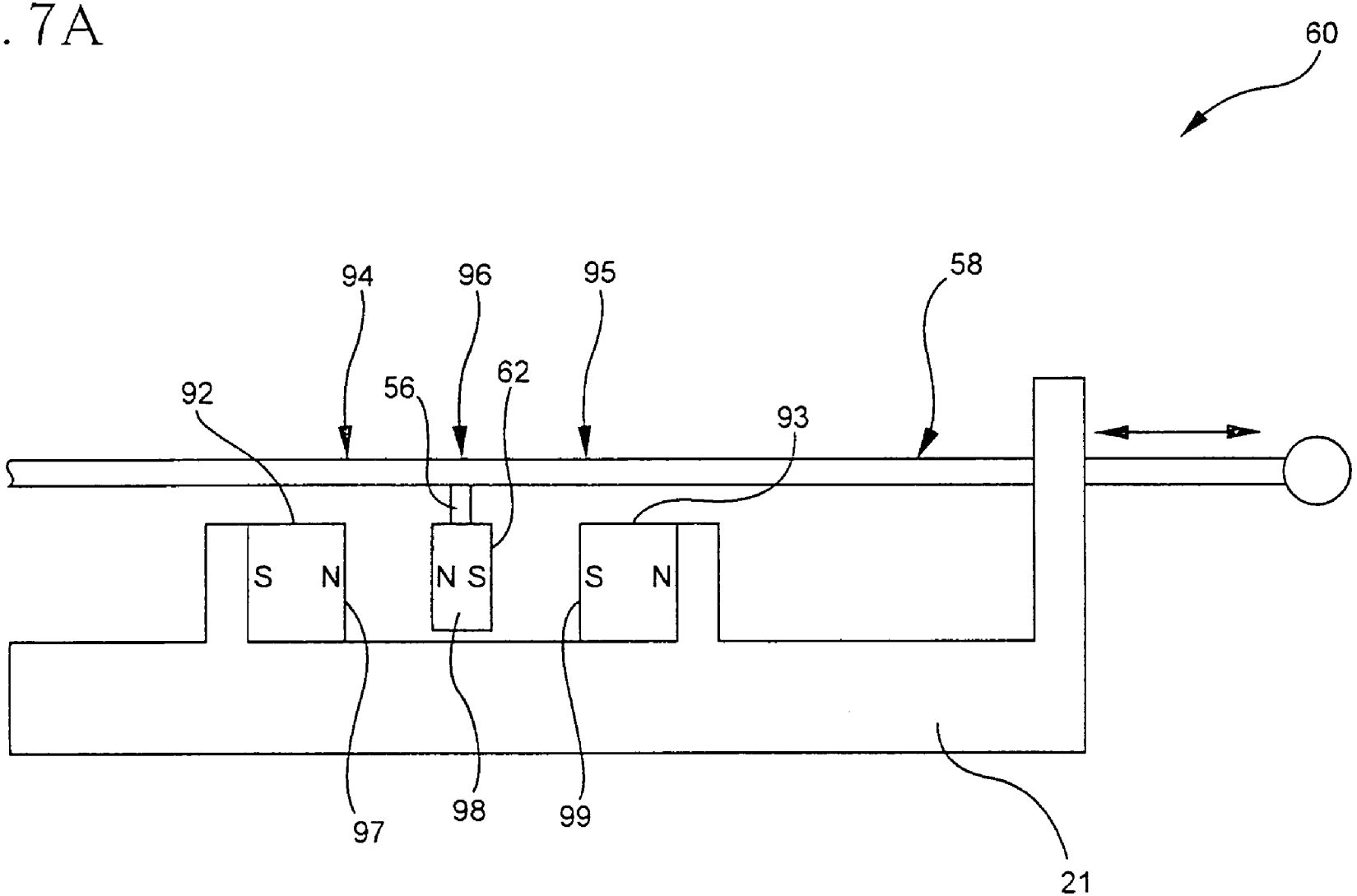
FIG. 7*a-c* shows an embodiment of the invention.
Figure 7B:
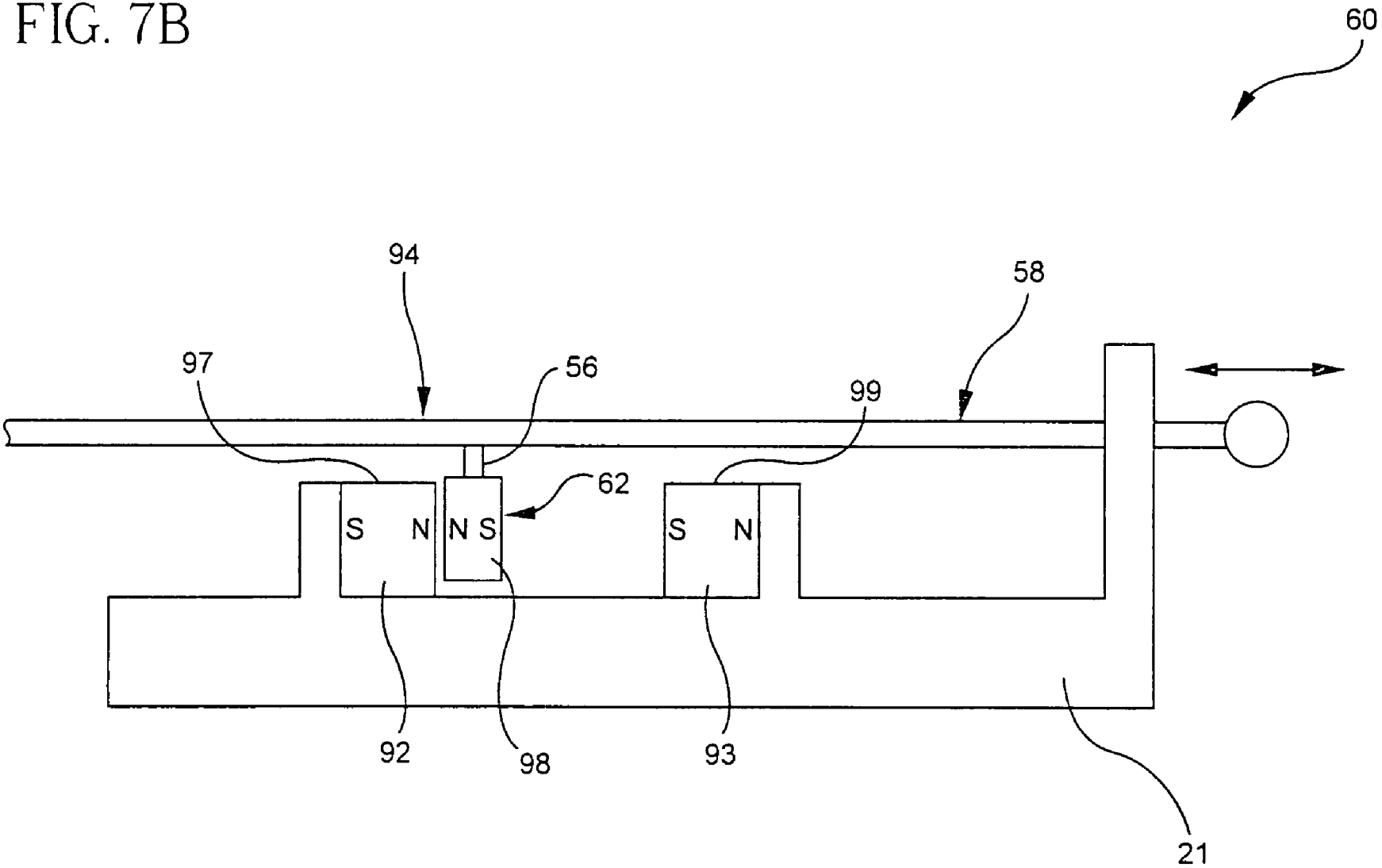
Figure 7C:
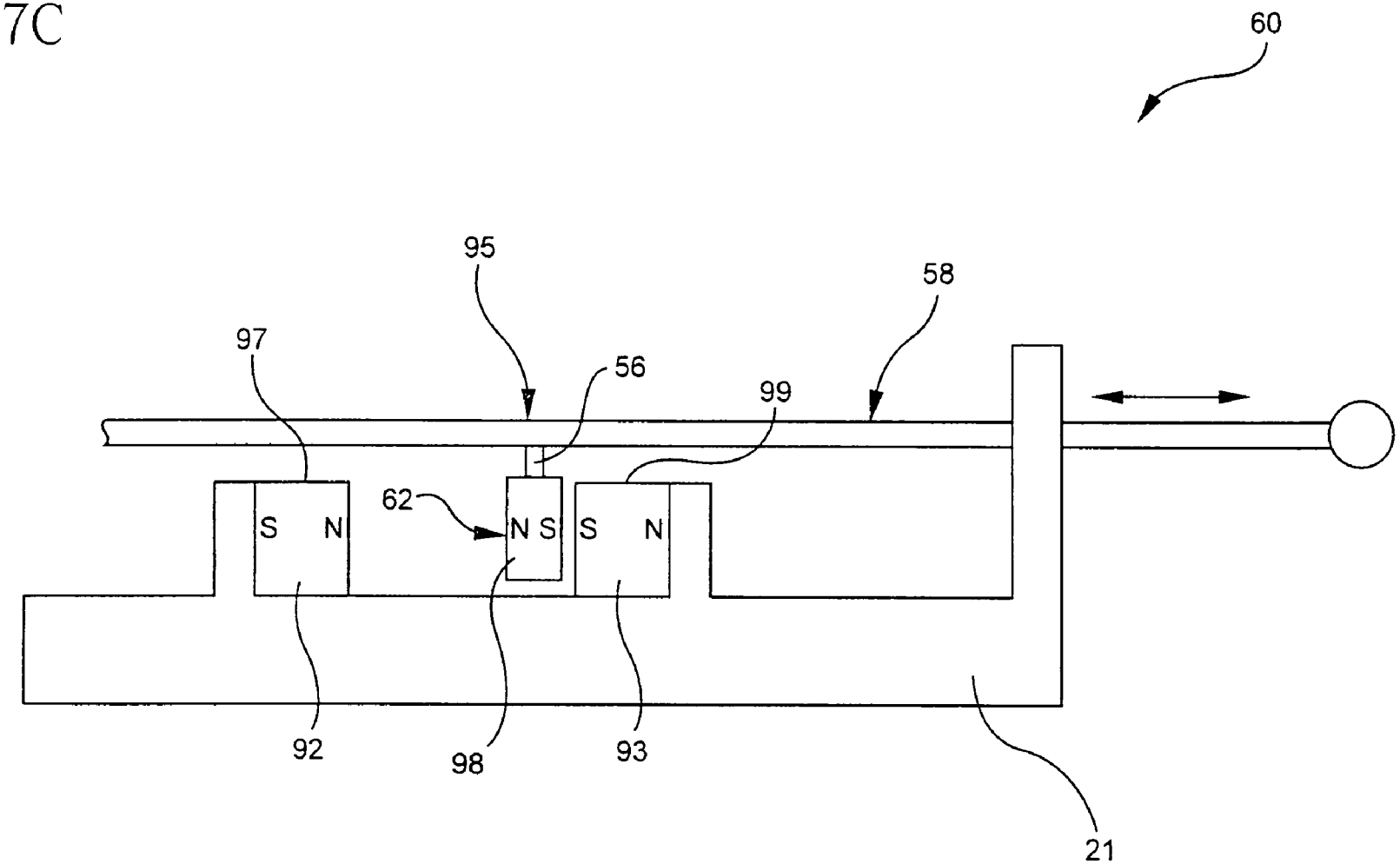

The invention includes a magnetic control switch. The magnetic control switch includes a magnetic anchor and a first magnetic target and a second magnetic target. The magnetic anchor has a first position adjacent to the first magnetic target and a second position adjacent to the second magnetic target wherein a first magnetic field between the magnetic anchor and the first target and a second magnetic field between the magnetic anchor and the second target bias positioning the magnetic control switch in a home position. In an embodiment the home position is between the first position and the second position. In an embodiment the home positions are at the second position and the first position. As shown in FIGS. 4*a-b* and 6 the magnetic control switch includes magnetic anchor 62 and first magnetic target 65 and a second magnetic target 67. The magnetic anchor 62 has a first position 64 adjacent to the first magnetic target 65 and a second position 66 adjacent to the second magnetic target 67 wherein a first magnetic field between the magnetic anchor 62 and the first target 65 and a second magnetic field between the magnetic anchor 62 and the second target 67 bias positioning the magnetic control switch in a first home position 64 and a second home position 66. The first home position 64 provides for adjustment of the tilt limit while the rotators are disengaged and the second home position 66 provide for maintaining the engagement of the rotators and the adjusted to endstop position. As shown in FIG. 7, the magnetic control switch includes magnetic anchor 62 and a first magnetic target 92 and a second magnetic target 93. The magnetic anchor 62 has a first position 94 adjacent to the first magnetic target 92 and a second position 95 adjacent to the second magnetic target 93 wherein a first magnetic field between the magnetic anchor 62 and the first target 92 and a second magnetic field between the magnetic anchor 62 and the second target 93 bias positioning the magnetic control switch in home position 96 between the first position and the second position. As shown in the embodiment of FIG. 7, the magnetic anchor 62 is an oriented north-south (N-S) magnet 98, the first target 92 is an oriented south-north (S-N) magnet 97, and the second target 93 is an oriented south-north (S-N) magnet 99 with the magnetically biased home position 96 between the first target 92 and the second target 93.

The invention includes a magnetic control switch. The magnetic control switch 60 is comprised of a control arm 58, the control arm has an engaged position 96 and a disengaged position 94, a magnetic anchor 62, a first magnetic target 92 and a second magnetic target 93 wherein a first magnetic repulsion between the magnetic anchor 62 and the first target 92 and a second magnetic repulsion between the magnetic anchor 62 and the second target 93 bias positioning the control arm 58 in an engaged control position 96 between the first magnetic target 92 and the second magnetic target 93.

It will be apparent to those skilled in the art that various modifications and variations can be made to the present invention without departing from the spirit and scope of the invention. Thus, it is intended that the present invention cover the modifications and variations of this invention provided they come within the scope of the appended claims and their equivalents.

The invention claimed is:

1. A flexible tilting recline seatback tilt limiter for adjustably limiting the flexible tilting recline motion of a flexible tilting recline seatback having a flexible tilting recline motion between a full forward seatback position and a full recline backward seatback position, the flexible tilting recline seatback tilt limiter comprised of a first rotator with repeating periodic protrusions, the first rotator having a full forward seatback upright endstop and a full recline seatback endstop, and a second rotator with repeating periodic receivers, the second rotator having an adjustment endstop, the first rotator periodic protrusions disengagably received by the second rotator receivers, wherein the first rotator is free to rotate between the full forward seatback upright endstop and the full recline seatback endstop when the protrusions are disengaged and not received in the second rotator receivers and the second rotator adjustment endstop limits the rotation of the first rotator to an adjustable reclined seatback tilt limit when the protrusions are received in the second rotator receivers with the adjustable reclined seatback tilt limit stopping the flexible tilting recline motion of the seatback beyond the adjustable reclined seatback tilt limit in a backwards tilting direction towards the full recline backward seatback position wherein the flexible tilting recline seatback tilt limiter allows a repeated flexible tilting recline seatback motion of the flexible tilting recline seatback between the full forward seatback upright endstop and the adjustable reclined seatback tilt limit with the first rotator free to rotate between the forward upright position and the adjustable reclined seatback tilt limit with the first rotator periodic protrusions received by the second rotator receivers.

2. A seatback tilt limiter as claimed in claim 1, the seatback tilt limiter including a magnetic control switch, the magnetic control switch controlling an engagement and disengagement of the protrusions in the receivers.

3. A seatback tilt limiter as claimed in claim 2, the magnetic control switch having a magnetic anchor, the magnetic anchor having a seatback tilt adjustment position wherein the magnetic anchor inhibits engagement of the protrusions in the receivers when the magnetic anchor is in the seatback tilt adjustment position.

4. A seatback tilt limiter as claimed in claim 2, the magnetic control switch having a magnetic anchor, the magnetic anchor having a seatback limited tilt position wherein the magnetic anchor inhibits disengagement of the protrusions in the receivers when the magnetic anchor is in the seatback limited tilt position.

5. A seatback tilt limiter as claimed in claim 1, the seatback tilt limiter including a resilient member for biasing engagement of the protrusions in the receivers.

6. A seatback tilt limiter as claimed in claim 1, wherein the first rotator having a center axis of rotation and the first rotator full forward seatback upright endstop having an offcenter nonradial endstop contact surface for endstop contact with a housing full forward endstop contact abutment surface.

7. A seatback tilt limiter as claimed in claim 1, wherein the first rotator having a center axis of rotation and the first rotator full recline seatback endstop having an offcenter nonradial endstop contact surface for endstop contact with a housing full recline seatback endstop contact abutment surface.

8. A seatback tilt limiter as claimed in claim 1, wherein the second rotator having a center axis of rotation and the second rotator adjustment endstop having an offcenter nonradial endstop contact surface for endstop contact with a housing adjustment endstop contact abutment surface.

9. A seatback tilt limiter as claimed in claim 8, wherein the second rotator having a spring member, the spring member for biasing the second rotator adjustment endstop contact surface towards the housing adjustment endstop contact abutment surface.

10. A method of adjusting a flexible tilting recline tilt limit of a flexible tilting recline seatback having a flexible tilting recline motion between a forward upright position and a backward leaning reclined position, the method comprising: providing a first toothed rotator, the first toothed rotator having a forward seatback upright endstop and a recline seatback endstop, providing a second toothed rotator meshed to the first toothed rotator, the second toothed rotator having an adjustment endstop, disengaging the first toothed rotator from the second toothed rotator, positioning the flexible tilting recline seatback to an adjustable reclined seatback tilt limit with the first toothed rotator rotated relative to the second toothed rotator, engaging the first toothed rotator with the second toothed rotator wherein the seatback is limited to tilting between the forward seatback upright endstop and the adjustable reclined seatback tilt limit, and repeatedly tilting the seatback in a backwards direction from the forward upright position towards the backward leaning reclined position with the tilting stopped at the adjustable reclined seatback tilt limit with the first toothed rotator free to rotate between the forward upright position and the adjustable reclined seatback tilt limit when the second toothed rotator is meshed to the first toothed rotator.

11. A method as claimed in claim 10, the method including providing a magnetic control switch, the magnetic control switch having a magnetic anchor with a seatback tilt adjustment position and a seatback limited tilt position, and positioning the magnetic anchor at the seatback tilt adjustment position to disengage the first toothed rotator from the second toothed rotator and positioning the magnetic anchor at the seatback limited tilt position to engage the first toothed rotator with the second toothed rotator.

12. A method as claimed in claim 10 wherein disengaging the first toothed rotator from the second toothed rotator includes compressing a resilient member which biases engagement of the first toothed rotator with the second toothed rotator.

13. A method of making a flexible tilting recline seatback tilt limiter for adjustably limiting the flexible tilting recline of a seatback having a flexible tilting recline motion between a full forward seatback position and a full recline backward seatback position, the method comprising: providing a first toothed rotator having a forward seatback upright endstop and a recline seatback endstop, providing a second toothed rotator having an adjustment endstop, providing a resilient member for biasing an engagement of the first toothed rotator with the second toothed rotator, disengagably coupling the first toothed rotator and the second toothed rotator with the resilient member wherein a compression of the resilient member permits the first toothed rotator and the second toothed rotator to disengage to provide for relative rotation between the first toothed rotator and the second toothed rotator to establish an adjusted seatback tilt limit for stopping the flexible tilting recline motion of the seatback beyond said adjusted seatback tilt limit in a backwards tilting direction towards the full recline backward seatback position before the full recline backward seatback position is reached wherein the flexible tilting recline seatback tilt limiter allows a repetitive flexible tilting recline seatback motion of the flexible tilting recline seatback between the full forward seatback upright endstop and the adjustable reclined seatback tilt limit with the first toothed rotator free to rotate between the forward seatback upright endstop and the adjusted seatback tilt limit with the biased engagement of the first toothed rotator with the second toothed rotator.

14. A method as claimed in claim 13, the method including providing a magnetic control switch, the magnetic control switch having a magnetic anchor with a seatback tilt adjustment position for maintaining the compression of the resilient member.

15. A method as claimed in claim 13 wherein the first toothed rotator comprises a first gear and the second toothed rotator comprises a second gear.

16. A method as claimed in claim 13 wherein the first toothed rotator comprises an inner member and the second toothed rotator comprises an outer member.

17. A method as claimed in claim 13 wherein the first toothed rotator comprises an outer member and the second toothed rotator comprises an inner member.

18. A method as claimed in claim 13, wherein the first rotator having a center axis of rotation and the first rotator forward seatback upright endstop having an offcenter nonradial endstop contact surface for endstop contact with a housing full forward endstop contact abutment surface.

19. A method as claimed in claim 13 wherein the first rotator having a center axis of rotation and the first rotator recline seatback endstop having an offcenter nonradial endstop contact surface for endstop contact with a housing recline seatback endstop contact abutment surface.

20. A method as claimed in claim 13 wherein the second rotator having a center axis of rotation and the second rotator adjustment endstop having an offcenter nonradial endstop contact surface for endstop contact with a housing adjustment endstop contact abutment surface.

21. A method of making a flexible tilting recline seatback tilt limiter for adjustably limiting the flexible tilting recline motion of a seatback between a seatback forward upright endstop and a seatback recline endstop, the method comprising: providing a first toothed rotator gear member with a plurality of repeating periodic gear teeth, providing a second toothed gear member with a plurality of repeating periodic gear teeth and having an adjustment endstop, disengagably coupling the first toothed rotator gear member repeating periodic gear teeth with the second toothed gear member repeating periodic gear teeth wherein the second toothed gear member adjustment endstop provides an adjustable recline angle seatback endstop between said seatback forward upright endstop and said seatback recline endstop with the adjustable recline angle seatback endstop stopping the flexible tilting recline motion of the seatback beyond said adjustable recline angle seatback endstop in a backwards tilting direction towards the seatback recline endstop wherein the flexible tilting recline seatback tilt limiter allows a repetitive flexible tilting recline seatback motion of the seatback between the seatback forward upright endstop and the adjustable recline angle seatback endstop with the first toothed rotator gear member free to rotate between the seatback forward upright endstop and the adjustable recline angle seatback endstop while the first toothed rotator gear member repeating periodic gear teeth are coupled with the second toothed gear member repeating periodic gear teeth.

22. A method as claimed in claim 21, wherein providing a second toothed gear member with a plurality of repeating periodic gear teeth and having an adjustment endstop includes providing a sliding linear gear member.

23. A method as claimed in claim 21, wherein providing a second toothed gear member with a plurality of repeating periodic gear teeth and having an adjustment endstop includes providing a rotating gear member.

* * * * *